US009625862B2

(12) United States Patent
Kosaka

(10) Patent No.: US 9,625,862 B2
(45) Date of Patent: Apr. 18, 2017

(54) HEATER CONTROL DEVICE AND IMAGE FORMING APPARATUS

(71) Applicant: OKI DATA CORPORATION, Tokyo (JP)

(72) Inventor: Toru Kosaka, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/828,572

(22) Filed: Aug. 18, 2015

(65) Prior Publication Data

US 2016/0216662 A1 Jul. 28, 2016

(30) Foreign Application Priority Data

Jan. 23, 2015 (JP) ..... 2015-010789

(51) Int. Cl.
*G03G 15/20* (2006.01)
*H05B 1/02* (2006.01)
*G03G 15/00* (2006.01)

(52) U.S. Cl.
CPC ..... *G03G 15/2039* (2013.01); *G03G 15/55* (2013.01); *G03G 15/80* (2013.01); *H05B 1/0202* (2013.01); *H05B 1/0241* (2013.01)

(58) Field of Classification Search
CPC ..... G03G 15/2039; G03G 15/205; G03G 15/2053; G03G 15/55; G03G 2215/2035
USPC ..... 399/33
See application file for complete search history.

(56) References Cited

U.S. PATENT DOCUMENTS 6,118,228 A * 9/2000 Pal ..... H05B 41/2981 315/209 R
6,317,571 B1 * 11/2001 Adams ..... G03G 15/2003 399/67
2007/0230981 A1 * 10/2007 Cho ..... G03G 15/80 399/69
2011/0090726 A1 * 4/2011 Brotto ..... H02J 7/0065 363/131

FOREIGN PATENT DOCUMENTS

JP 2013-235107 A 11/2013

OTHER PUBLICATIONS

Machine translation of Kojima JP 2013-235107 A, publication date: Nov. 21, 2013.*

* cited by examiner

*Primary Examiner* — Walter L Lindsay, Jr.
*Assistant Examiner* — Frederick Wenderoth
(74) *Attorney, Agent, or Firm* — Kubotera & Associates, LLC

(57) ABSTRACT

A heater control device includes a power factor correction circuit configured to convert an alternate current voltage from a commercial power source to a direct current voltage; an inverter configured to generate a specific alternate current voltage from the direct current voltage converted with the power factor correction circuit; a heater configured to receive the specific alternate current voltage generated with the inverter; and an excessive temperature rise preventing portion configured to interrupt the specific alternate current voltage generated with the inverter from being supplied to the heater.

12 Claims, 17 Drawing Sheets

FIG. 9 (A) PWM_D
FIG. 9 (B) PWM_C
FIG. 9 (C) PWM_A
FIG. 9 (D) PWM_B
DEAD TIME
DEAD TIME
DEAD TIME
DEAD TIME
DEAD TIME
(E)
0 10 20 30 40 50 60 70 80 90 100 110 120 130 140 150 160 170 180 190 200 210 220 230 240 250 260 270 280 290 300 310 320 330 340 350

HEATER CONTROL DEVICE AND IMAGE FORMING APPARATUS

BACKGROUND OF THE INVENTION AND RELATED ART STATEMENT

The present invention relates to a heater control device and an image forming apparatus including the heater control device. More specifically, the present invention relates to a heater control device using an inverter, and an image forming apparatus including the heater control device.

In a conventional image forming apparatus, an image forming unit forms a toner image. After the toner image is transferred to a medium, a fixing device fixes the toner image to the medium. The fixing device includes a heater for heating. The conventional image forming apparatus further includes a triac for controlling power from a commercial power source, so that the heater is controlled to heat (refer to, for example, Patent Reference).

Patent Reference: Japanese Patent Publication No. 2013-235107

In the conventional image forming apparatus disclosed in Patent Reference, the triac is configured to directly turn on or turn off the commercial power source. Accordingly, it is necessary to dispose different fixing devices according to a voltage of the power source. Further, when it is tried to change power supplied to the heater, it is necessary to control a phase or a frequency number. When it is tried to control the phase, an electrical current may jump rapidly, thereby deteriorating conductive noise. When it is tried to control the frequency number, a flicker may be caused. Among power sources of the conventional image forming apparatus, a direct current (DC) power source is a stabilized power source. However, an alternate current (AC) power source to be applied to the heater is not a stabilized power source.

In order to solve the problems of the conventional image forming apparatus described above, an object of the present invention is to provide a heater control device and an image forming apparatus capable of stably supplying a voltage to a heater regardless of the commercial power source.

Further objects and advantages of the invention will be apparent from the following description of the invention.

SUMMARY OF THE INVENTION

In order to attain the objects described above, according to a first aspect of the present invention, a heater control device includes a power factor correction circuit configured to convert an alternate current voltage from a commercial power source to a direct current voltage; an inverter configured to generate a specific alternate current voltage from the direct current voltage converted with the power factor correction circuit; a heater configured to receive the specific alternate current voltage generated with the inverter; and an excessive temperature rise preventing portion configured to interrupt the specific alternate current voltage generated with the inverter from being supplied to the heater.

According to the present invention, it is possible to provide the heater control device and an image forming apparatus capable of stably supplying a voltage to the heater regardless of the commercial power source.

DETAILED DESCRIPTION OF PREFERRED EMBODIMENTS

Hereunder, embodiments of the present invention will be explained with reference to the accompanying drawings.

First Embodiment

Figure 1:
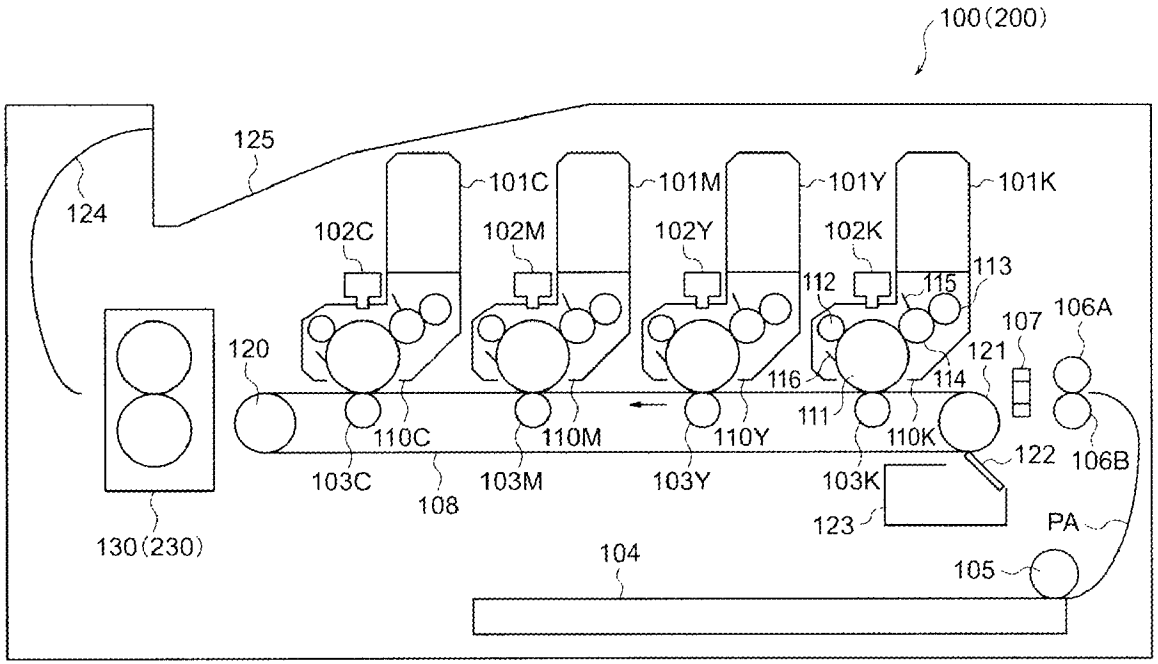
FIG. 1 is a schematic sectional view showing a configuration of an image forming apparatus according to a first embodiment of the present invention.

A first embodiment of the present invention will be explained. FIG. 1 is a schematic sectional view showing a configuration of an image forming apparatus 100 according to the first embodiment of the present invention. It should be noted that the image forming apparatus 100 is a color image forming apparatus, and may be a monochrome image forming apparatus.

As shown in FIG. 1, the image forming apparatus 100 includes toner cartridges 101K, 101Y, 101M, and 101C (in the following description, also referred to collectively as toner cartridges 101 if it is not necessary to differentiate). Further, the image forming apparatus 100 includes light emitting diode (LED) heads 102K, 102Y, 102M, and 102C (in the following description, also referred to collectively as LED heads 102 if it is not necessary to differentiate).

In the first embodiment, the image forming apparatus 100 further includes developing units 110K, 110Y, 110M, and 110C (in the following description, also referred to collectively as developing units 110 if it is not necessary to differentiate). Further, the image forming apparatus 100 includes transfer rollers 103K, 103Y, 103M, and 103C (in the following description, also referred to collectively as transfer rollers 103 if it is not necessary to differentiate).

In the first embodiment, the image forming apparatus 100 further includes a sheet cassette 104; a hopping roller 105; and register rollers 106A and 106B (in the following description, also referred to collectively as register rollers 106 if it is not necessary to differentiate). Further, the image forming apparatus 100 includes a sheet detection sensor 107; a transfer belt 108; a drive roller 120; a follower roller 121; a transfer belt cleaning blade 122; a cleaner container 123; a fixing device 130; a sheet guide 124; and a sheet discharge tray 125. It should be noted that a reference numeral in a parenthesis corresponds to a component in the second embodiment.

In the first embodiment, the developing units 110 are image forming units for forming toner images as developer images. Each of the developing units 110 includes a photosensitive drum 111; a charging roller 112; a supplying roller 113; a developing roller 114; a developing blade 115; and a cleaning blade 116.

In the first embodiment, the charging roller 112 is configured to uniformly charge the photosensitive drum 111. After the photosensitive drum 111 is charged, the LED heads 102 irradiate light to form static latent images on the photosensitive drum 111. The toner cartridges 101 are detachably attached to the developing units 110, and retain toner as developer. The supplying rollers 113 are configured to supply toner retained in the toner cartridges 101 to the developing rollers 114. After toner is supplied to the developing rollers 114, the developing blades 115 form a uniform toner layer on the developing rollers 114. After the uniform toner layer is formed on the developing rollers 114, toner is attached to the static latent images formed on the photosensitive drum 111, so that the toner images are formed on surfaces of the photosensitive drums 111. The cleaning blades 116 are disposed for cleaning toner remaining on the photosensitive drums 111.

In the first embodiment, the sheet cassette 104 is configured to retain a sheet PA as a medium therein. The hopping roller 105 is provided for transporting the sheet PA from the sheet cassette 104. The register roller 106 is provided for transporting the sheet PA to the transfer belt 108 at an appropriate timing. The sheet detection sensor 107 is provided for detecting the sheet PA passing through the sheet detection sensor 107 in a contact or non-contact fashion.

In the first embodiment, the transfer belt 108 is extended between the drive roller 120 and the follower roller 121. The drive roller 120 is provided for moving the transfer belt 108 with a drive of a motor, so that the sheet PA on the transfer belt 108 is transported. The transfer roller 103 is provided for applying a bias to a transfer nip portion from a backside of the transfer belt 108, so that the toner image formed on the photosensitive drum 111 is transferred to the sheet PA. Further, the transfer belt cleaning blade 122 is arranged to scrape off toner remaining on the transfer belt 108, so that toner thus scraped off is collected in the cleaner container 123. The fixing device 130 is configured to fix the toner image transferred to the sheet PA through applying heat and pressure. The sheet guide 124 is provided for discharging the sheet PA with a backside thereof facing downwardly to the sheet discharge tray 125.

Figure 2:
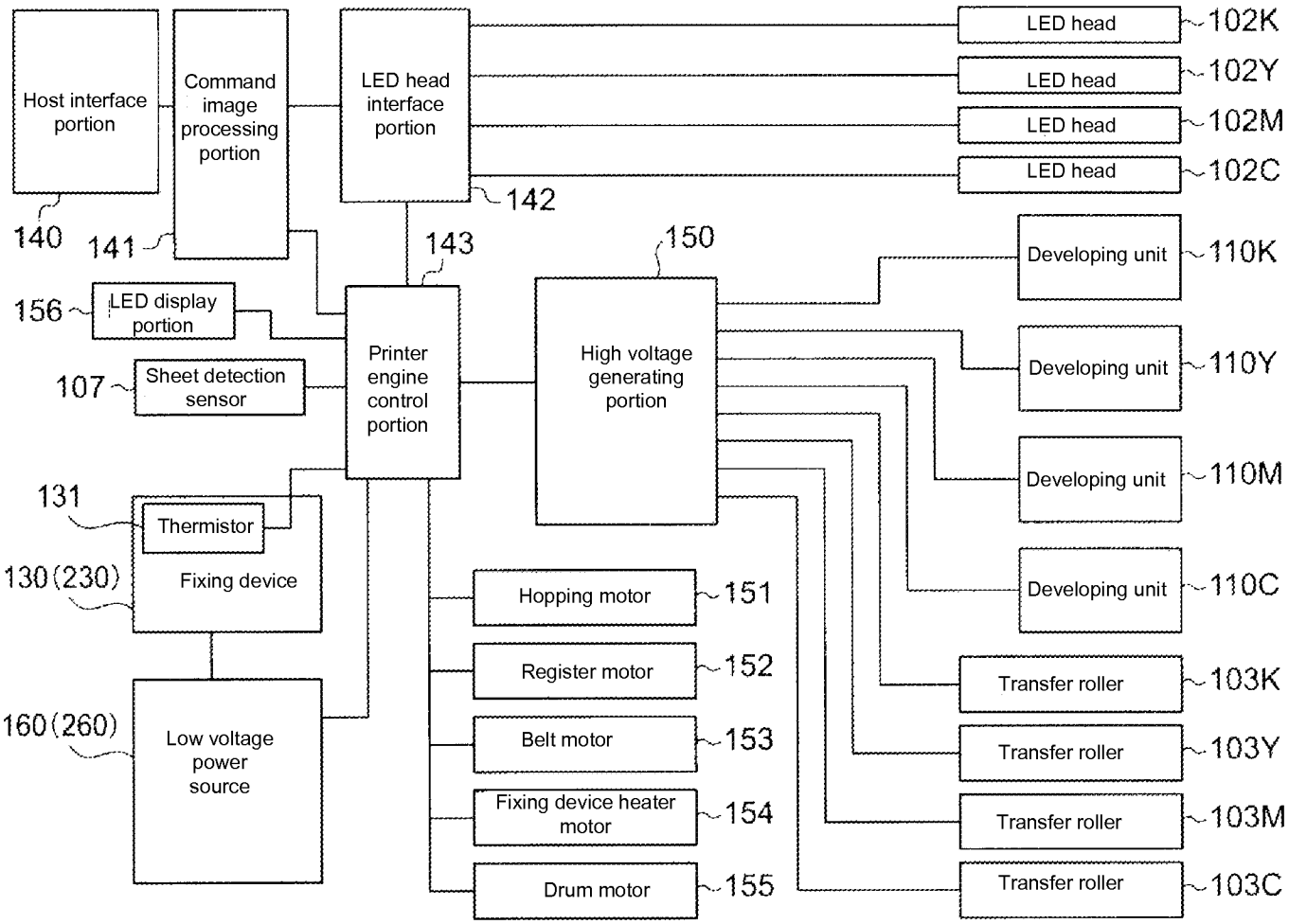
FIG. 2 is a block diagram showing a control system of the image forming apparatus according to the first embodiment of the present invention.

FIG. 2 is a block diagram showing a control system of the image forming apparatus 100 according to the first embodiment of the present invention.

As shown in FIG. 2, the control system of the image forming apparatus 100 includes a host interface portion 140; a command image processing portion 141; an LED head interface portion 142; and a printer engine control portion 143 functioning as a main control portion. It should be noted that the reference numeral in the parenthesis corresponds to a component in the second embodiment.

In the first embodiment, the command image processing portion 141 is provided for transmitting and receiving data to and from the command image processing portion 141. The command image processing portion 141 is provided for outputting image data to the LED head interface portion 142. Further, the printer engine control portion 143 is provided for controlling a head driving pulse and the like of the LED head interface portion 142, so that the LED heads 102 irradiate light.

In the first embodiment, the printer engine control portion 143 is configured to transmit a signal to a high voltage generating portion 150 to generate a high voltage, so that a bias is applied to the developing units 110 and the transfer rollers 103. In this case, the sheet detection sensor 107 is used to adjust a timing of generating a transfer bias. Further, the printer engine control portion 143 is configured to control a hopping motor 151, a register motor 152, a belt motor 153, a fixing device heater motor 154, and a drum motor 155 to drive at specific timings. An LED display portion 156 is a display portion controlled by the printer engine control portion 143. A low voltage power source 160 is provided as a power source device for supplying power to the fixing device 130. Further, the printer engine control portion 143 is configured to control a temperature of the fixing device 130 according to a detection value of a thermistor 131.

Figure 3:
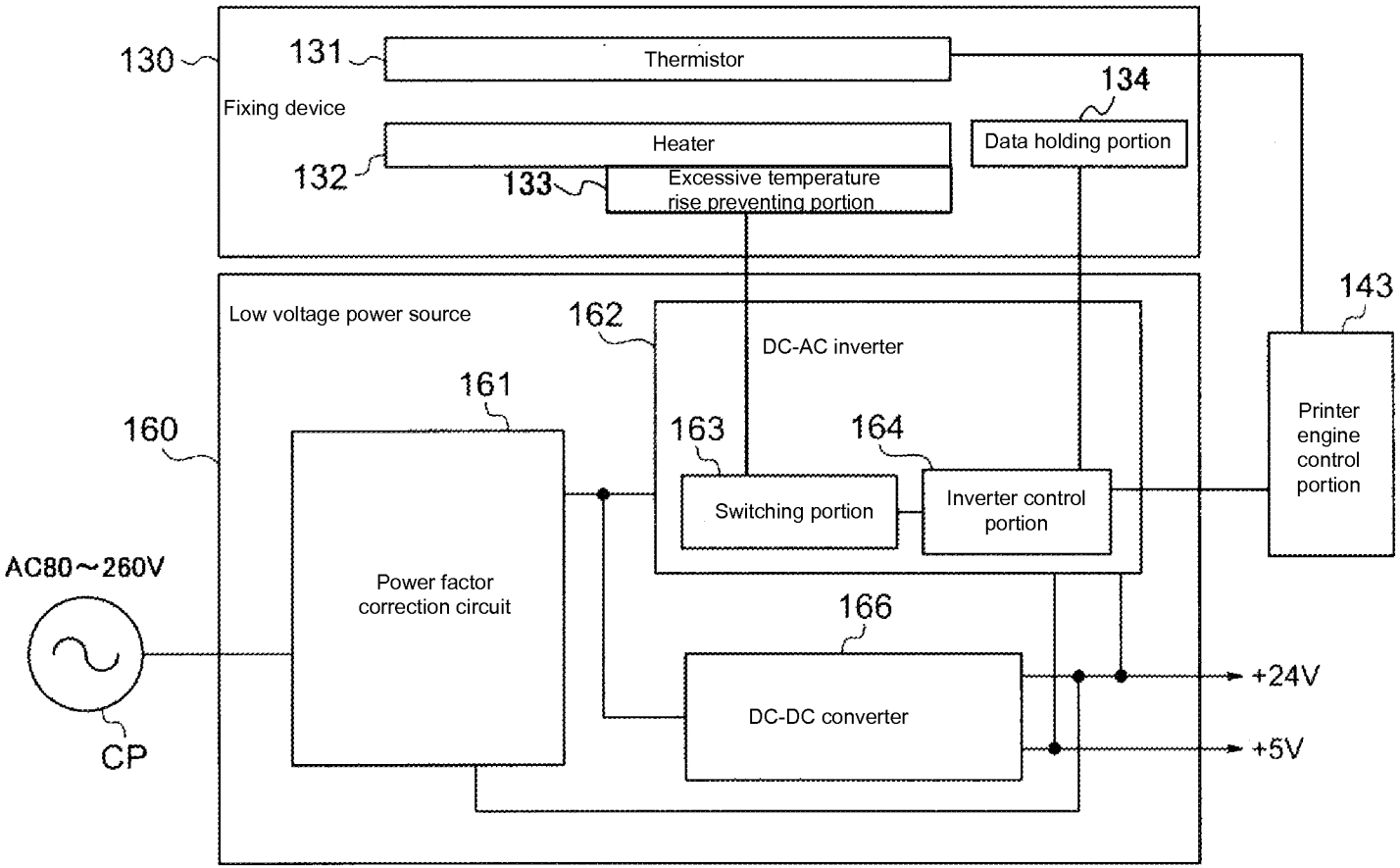
FIG. 3 is a block diagram showing configurations of a fixing device and a low voltage power source of the image forming apparatus according to the first embodiment of the present invention.

FIG. 3 is a block diagram showing configurations of the fixing device 130 and the low voltage power source 160 of the image forming apparatus 100 according to the first embodiment of the present invention.

As shown in FIG. 3, the fixing device 130 includes the thermistor 131; a heater 132; an excessive temperature rise preventing portion 133; and a data holding portion 134. In the first embodiment, a halogen heater is used as the heater 132. Alternatively, for example, a ceramic eater and the like may be used as the heater 132. In general, the halogen heater tends to have a plus-minus fluctuation in power consumption when a standard voltage is applied to the halogen heater. Accordingly, it is necessary to design a device using the halogen heater such that power consumption of the device is controlled within a specific range even the halogen heater has a plus fluctuation. In this case, when the halogen heater has a minus fluctuation, it is difficult to quickly increase a temperature thereof. It should be noted that when the power source voltage is fluctuated, it is also difficult to quickly increase a temperature of the halogen heater.

In the first embodiment, the thermistor 131 is provided for detecting a temperature of the heater 132. The excessive temperature rise preventing portion 133 is configured as a temperature adjusting portion for adjusting the temperature of the heater 132. More specifically, when the temperature of the heater 132 exceeds a threshold value specified in advance, the excessive temperature rise preventing portion 133 is configured to mechanically interrupt power supplied to the heater 132. For example, the heater 132 may be formed of a thermostat.

In the first embodiment, the data holding portion 134 is configured as a storage portion for storing an attribute value indicating a variance of a resistivity value of the heater 132. It should be noted that the attribute value increases as the resistivity value of the heater 132 increases. More specifically, the attribute value is proportional to the resistivity value of the heater 132 divided by a reference value specified in advance. The reference value is a resistivity value such that the heater 132 has power consumption specified in advance when a standard voltage is applied to the heater 132. Further, the data holding portion 134 may be formed of a wireless communication tag such as a radio frequency identifier (RFID), or a storage device such as a non-volatile memory.

In the first embodiment, the low voltage power source 160 receives an alternate current (AC) voltage externally from a commercial power source CP. The commercial power source generally outputs a voltage between 80 V and 260 V including a fluctuation variation in a power source voltage over worldwide. The low voltage power source 160 includes a power factor correction circuit 161; a DC-AC inverter 162; and a DC-DC converter 166.

In the first embodiment, the power factor correction circuit 161 is configured to convert the AC voltage supplied from the commercial power source CP to a direct current voltage, and to output the direct current (DC) voltage. More specifically, the power factor correction circuit 161 is configured to receive the AC voltage supplied from the commercial power source CP, and outputs the direct current (DC) voltage of +390 V. It should be noted that the direct current (DC) voltage of +390 V is frequently used for a power factor correction (PFC) circuit, and the direct current voltage may have a different level.

In the first embodiment, the DC-AC inverter 162 is configured as an inverter that converts a direct current voltage to an alternate current voltage. More specifically, the DC-AC inverter 162 is configured to convert the direct current (DC) voltage of +390 V output from the power factor correction circuit 161 to the alternate current (AC) voltage having a maximum effective voltage value within a variable range between 0 V and 220 V. The DC-AC inverter 162 includes a switching portion 163 and an inverter control portion 164. With the configuration described above, the DC-AC inverter 162 converts the direct current (DC) voltage to the alternate current (AC) voltage having a desirable level to be applied to the heater 132. It should be noted that the DC-AC inverter 162 adjusts the alternate current (AC) voltage thus generated according to the resistivity value of the heater 132, so that power consumption of the heater 132 is maintained at a constant level.

In the first embodiment, the DC-DC converter 166 is configured to decrease the direct current (DC) voltage to a different level. More specifically, the DC-DC converter 166 configured to decrease the direct current (DC) voltage of 390 V supplied from the power factor correction circuit 161 through a transformer and the like, so that the DC-DC converter 166 generates the direct current (DC) voltage of 24 V and 5 V. It should be noted that the low voltage power source 160, the printer engine control portion 143, and the heater 132 collectively constitute a heater control device.

Figure 4:
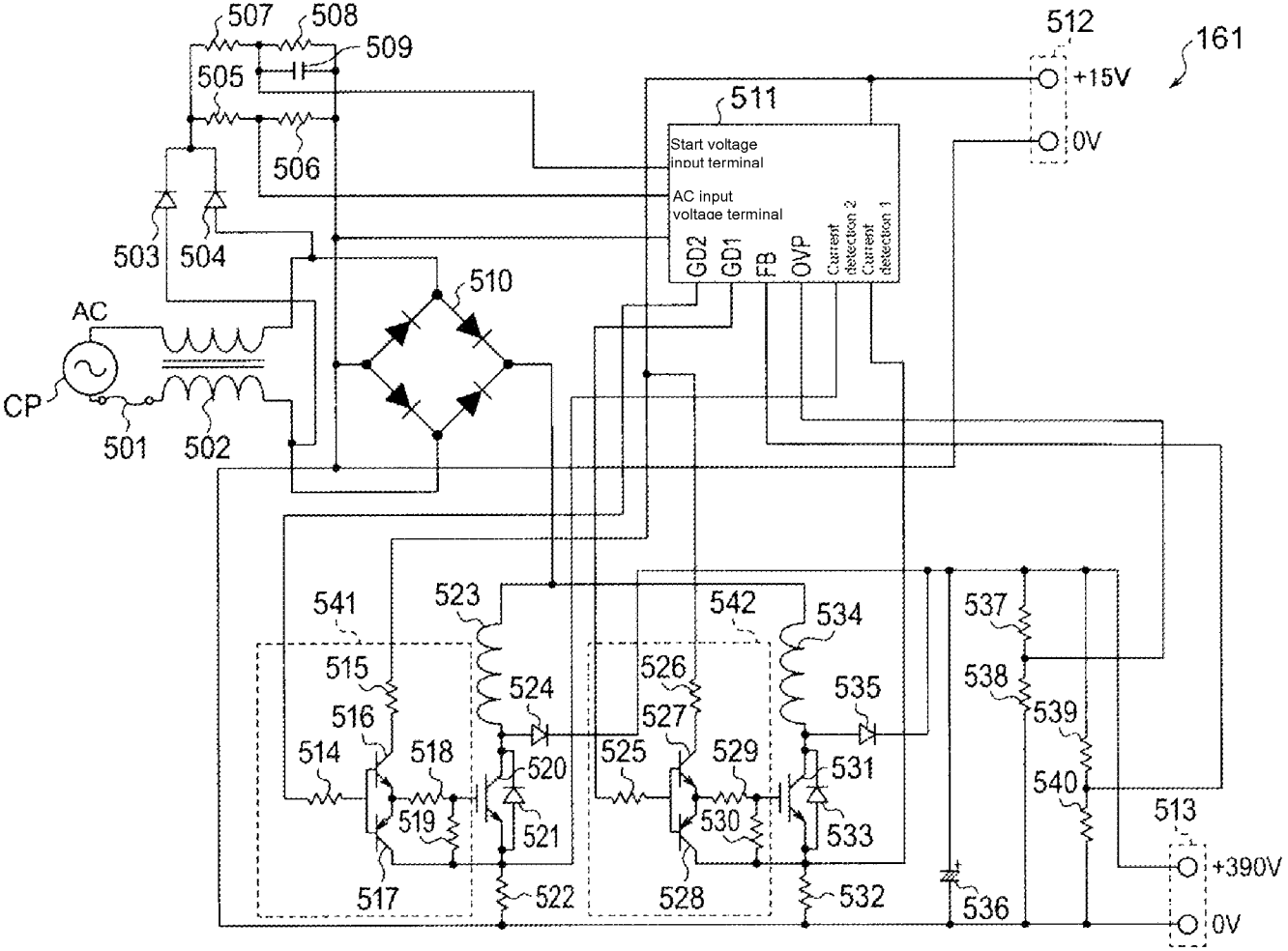
FIG. 4 is a circuit diagram showing a power factor correction circuit of the image forming apparatus according to the first embodiment of the present invention.

FIG. 4 is a circuit diagram showing the power factor correction circuit 161 of the image forming apparatus 100 according to the first embodiment of the present invention.

As shown in FIG. 4, the power factor correction circuit 161 includes a fuse 501; a common mode choke coil 502; a diode 503; a diode 504; resistors 505-508; a capacitor 509; and a bridge diode 510. Further, the power factor correction circuit 161 includes a PFC control integrated circuit (IC) 511; a power source inputting portion 512 for inputting the direct current voltage of 15 V; and a power source outputting portion 513 for outputting the direct current voltage of 390 V.

In the first embodiment, the power factor correction circuit 161 further includes a resistor 514; a resistor 515; an NPN transistor 516; a PNP transistor 517; a resistor 518; a resistor 519; an insulation gate bipolar transistor (IGBT) 520; a diode 521; a temperature detecting resistor 522; an inductor 523; and a diode 524. It should be noted that the diode 521 may be disposed in the IGBT 520.

In the first embodiment, the power factor correction circuit 161 further includes a resistor 525; a resistor 526; an NPN transistor 527; a PNP transistor 528; a resistor 529; a resistor 530; an insulation gate bipolar transistor (IGBT) 531; a temperature detecting resistor 532; a diode 533; an inductor 534; and a diode 535. It should be noted that the diode 533 may be disposed in the IGBT 531. Further, the power factor correction circuit 161 includes an electrolytic capacitor 536; a resistor 537; a resistor 538; a resistor 539; and a resistor 540. An area denoted with the reference numeral 541 represents a gate drive control circuit 541, and an area denoted with the reference numeral 542 represents a gate drive control circuit 542.

Figure 5:
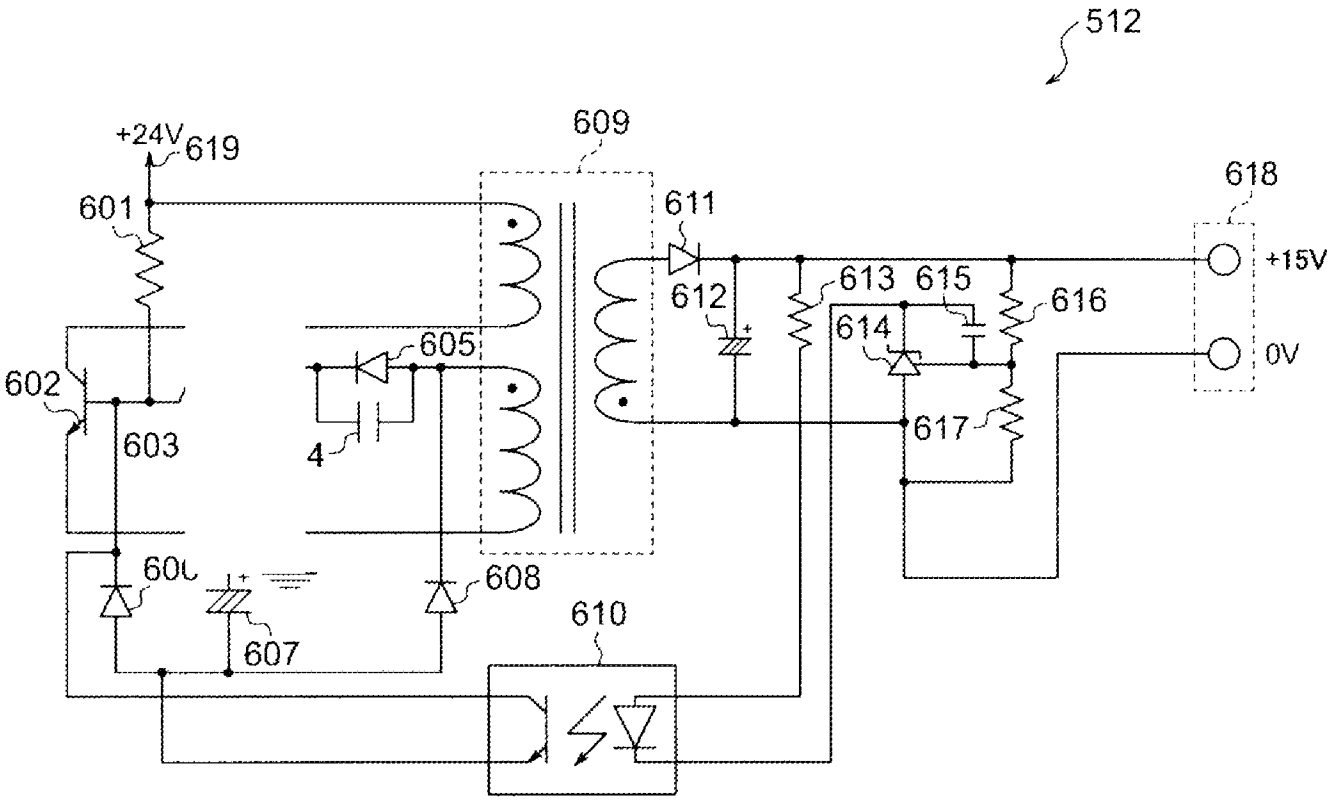
FIG. 5 is a circuit diagram showing a power source inputting portion of a direct current (DC) voltage 15 V of the image forming apparatus according to the first embodiment of the present invention.

FIG. 5 is a circuit diagram showing the power source inputting portion 512 for inputting the direct current (DC) voltage of 15 V of the image forming apparatus 100 according to the first embodiment of the present invention.

In the first embodiment, the power source inputting portion 512 is configured as a DC-DC converter in which a primary side and a secondary side are insulated with a transformer 609. Further, the power source inputting portion 512 is configured to convert the DC voltage or 24 V output from the DC-DC converter 166 to the DC voltage of 15 V electrically insulated. It should be noted that the DC-AC inverter 162 includes a power source inputting portion having a configuration similar to that of the power source inputting portion 512.

As shown in FIG. 5, the power source inputting portion 512 includes a resistor 601; an NPN transistor 602; a resistor 603; a capacitor 604; a diode 605; a diode 606; an electrolytic capacitor 607; a diode 608; the transformer 609; and a photo-coupler 610. Further, the power source inputting portion 512 includes a diode 611; an electrolytic capacitor 612; a resistor 613; a Shunt regulator 614; a capacitor 615; a resistor 616; a resistor 617; an outputting portion 618 for outputting the DC voltage of 15 V; and an inputting portion 619 for inputting the DC voltage of 24 V.

Figure 6:
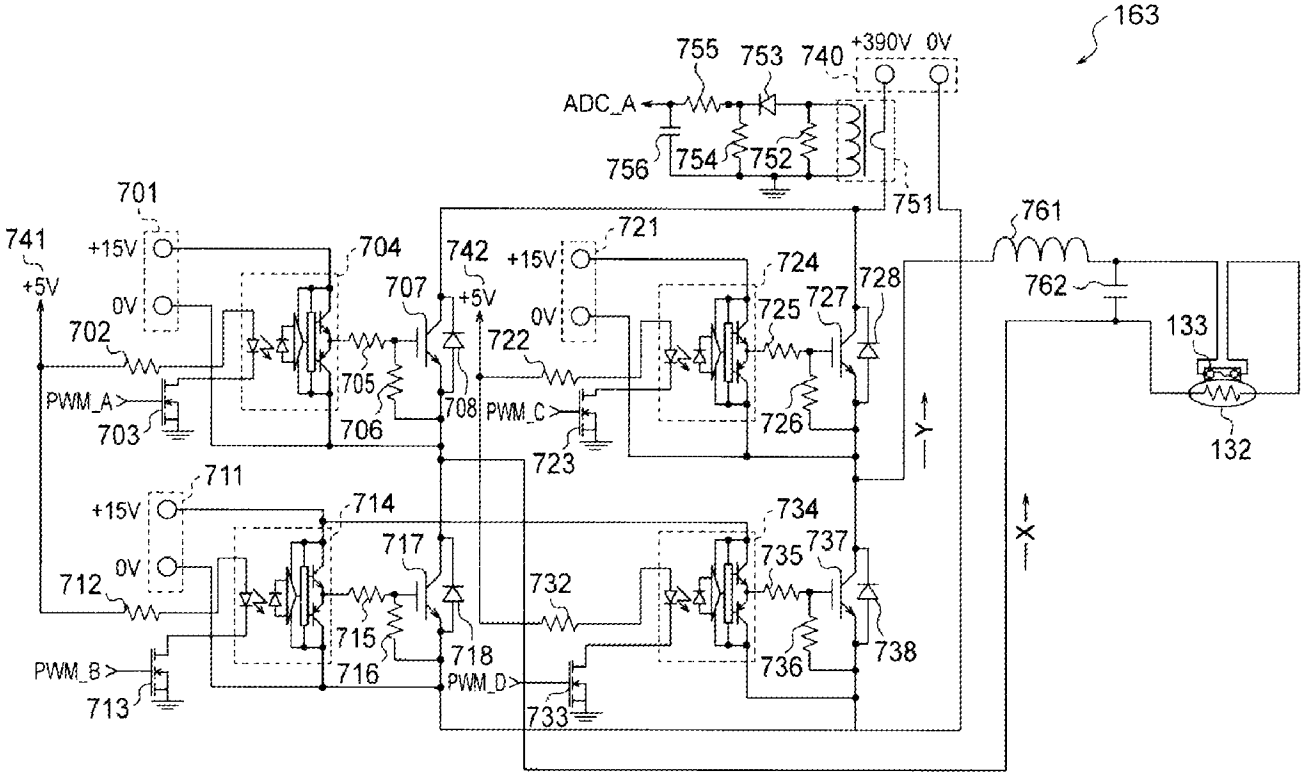
FIG. 6 is a circuit diagram showing a configuration of a switching portion of a DC-AC inverter of the image forming apparatus according to the first embodiment of the present invention.

FIG. 6 is a circuit diagram showing a configuration of the switching portion 163 of the DC-AC inverter 162 of the image forming apparatus 100 according to the first embodiment of the present invention. It should be noted that the switching portion 163 of the DC-AC inverter 162 is configured such that a switching timing thereof is controlled according to a pulse width modulation (PWM) signal output from the inverter control portion 164.

As shown in FIG. 6, the switching portion 163 includes a power source inputting portion 701 for inputting the DC voltage of 15 V; a power source inputting portion 711 for inputting the DC voltage of 15 V; and a power source inputting portion 721 for inputting the DC voltage of 15 V. Further, the switching portion 163 includes a resistor 702; a resistor 712; a resistor 722; a resistor 732; an N-channel field effect transistor (FET) 703; an N-channel field effect transistor (FET) 713; an N-channel field effect transistor (FET) 723; an N-channel field effect transistor (FET) 733; a gate driving photo-coupler 704; a gate driving photo-coupler 714; a gate driving photo-coupler 724; and a gate driving photo-coupler 734.

In the first embodiment, the switching portion 163 further includes a resistor 705; a resistor 706; a resistor 715; a resistor 716; a resistor 725; a resistor 726; a resistor 735; a resistor 736; an IGBT 707; an IGBT 717; an IGBT 727; an IGBT 737; a diode 708; a diode 718; a diode 728; and a diode 738. It should be noted that the diodes 708, 718, 728, and 738 may be disposed in the LGBTs 707, 717, 727, and 737, respectively.

In the first embodiment, the switching portion 163 further includes a power source inputting portion 740 for inputting the DC voltage of 390 V; a power source inputting portion 741 for inputting the DC voltage of 5 V; and a power source inputting portion 742 for inputting the DC voltage of 5 V. It should be noted that the switching portion 163 receives the DC voltage of 5 V through the power source inputting portion 741 and the power source inputting portion 742.

In the first embodiment, the switching portion 163 further includes a current transformer 751; a resistor 752; a diode 753; a resistor 754; a resistor 755; a capacitor 756; an inductor 761; and a capacitor 762. It should be noted that the current transformer 751, the resistor 752, the diode 753, the resistor 754, the resistor 755, and the capacitor 756 constitute an electrical current detecting portion for detecting an electrical current of the switching portion 163. Further, the DC-AC inverter 162 is connected to the heater 132 and the excessive temperature rise preventing portion 133.

Figure 7:
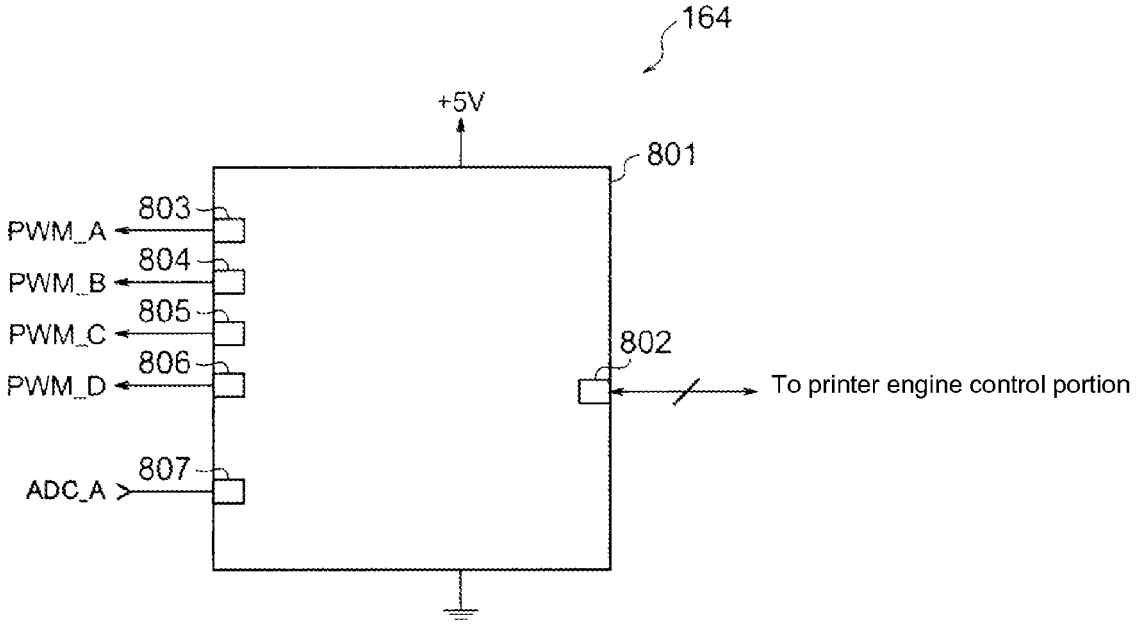
FIG. 7 is a block diagram showing a configuration of an inverter controlling portion of the DC-AC inverter of the image forming apparatus according to the first embodiment of the present invention.

FIG. 7 is a block diagram showing a configuration of the inverter controlling portion 164 of the DC-AC inverter 162 of the image forming apparatus 100 according to the first embodiment of the present invention.

In the first embodiment, the inverter control portion 164 is formed of an integrated circuit (IC) 801 such as a micro computer, an application specific integrated circuit (ASIC), a field-programmable gate array (FPGA), and the like. As shown in FIG. 7, the inverter control portion 164 includes a communication interface 802 for communicating with the printer engine control portion 143; a PWM output terminal 803; a PWM output terminal 804; a PWM output terminal 805; a PWM output terminal 806; and an ADC_A input terminal 807.

An operation of the image forming apparatus 100 will be explained next. The image forming apparatus 100 shown in FIG. 1 is configured to receive print data described with page description language (PDL) and the like from an external device (not shown) through the host interface portion 140 shown in FIG. 2. After the print data is input into the image forming apparatus 100, the command image processing portion 141 converts the print data to bit map data. After the heater 132 is controlled according to the detection value of the thermistor 131 such that the thermal fixing roller (not shown) of the fixing device 130 reaches a temperature determined in advance, the image forming apparatus 100 starts a printing operation.

In the first embodiment, when the image forming apparatus 100 starts the printing operation, the hopping roller 105 feeds the sheet PA retained in the sheet cassette 104, and the register rollers 106 transport the sheet PA on the transfer belt 108 at a timing synchronized to an image forming operation (described later). Afterward, the developing units 110 form the toner images on the photosensitive drums 111 through an electro-photography process. In this step, the LED heads 102 are turned on according to the bit map data. After the developing units 110 develop the toner images, the toner images are transferred to the sheet PA being transported on the transfer belt 108 through the bias applied to the transfer rollers 103. After the toner images in four colors are transferred to the sheet PA, the fixing device 130 fixes the toner images to the sheet PA, and the sheet PA is discharged. It should be noted that the toner cartridges 101 detachably attached to the developing units 110 supply toner retained therein to the developing units 110.

In the first embodiment, the printer engine control portion 143 shown in FIG. 2 is configured to control the high voltage generating portion 150 to generate the high voltage. The high voltage generated at the high voltage generating portion 150 is applied to the charging rollers 112, the developing rollers 114, and the transfer rollers 103. Further, the printer engine control portion 143 is configured to control the low voltage power source 160, so that power supplied to the fixing device 130 is controlled.

With reference to FIG. 3, the low voltage power source 160 receives power from the commercial power source CP, and boosts the alternate current voltage that is half-wave rectified with the power factor correction circuit 161 through switching. After the low voltage power source 160 boosts the alternate current voltage, the low voltage power source 160 outputs the direct current voltage of 390 V to the DC-AC inverter 162 and the DC-DC converter 166. Afterward, the DC-DC converter 166 switches the direct current voltage of 390 V, and outputs the direct current voltage of 24 V and the direct current voltage of 5 V decreased using the transformer having the primary side and the secondary side insulated.

In the first embodiment, the direct current voltage of 5 V is supplied to the logic system such as the printer engine control portion 143 and the like, and the direct current voltage of 24 V is supplied to the drive system such as the hopping motor 151 and the like. Further, the direct current voltage of 5 V is converted to the direct current voltage of 3.3 V and the like necessary for a specific circuit board is necessary. Further, the direct current voltage of 24 V and the direct current voltage of 5 V are supplied to the DC-AC inverter 162. Further, the direct current voltage of 24 V is supplied to the PFC control integrated circuit (IC) 511 of the power factor correction circuit 161.

In the first embodiment, the DC-AC inverter 162 outputs the alternate current voltage to the heater 132. The DC-AC inverter 162 is configured to switch the direct current voltage of 390 V output from the electrolytic capacitor 612, and rectifies the output thereof through the LC filter, so that 162 outputs the alternate current having an output effective value thus adjusted. It should be noted that the effective value of the alternate current voltage and the on-off of the output of the DC-AC inverter 162 are controlled according to the signal from the printer engine control portion 143. Further, the printer engine control portion 143 controls the on-off of the output of the DC-AC inverter 162 to be applied to the heater 132 according to the temperature detected with the thermistor 131 and an operational state of the image forming apparatus 100.

As described above, FIG. 4 is the circuit diagram showing the power factor correction circuit 161 of the image forming apparatus 100 according to the first embodiment of the present invention.

In the first embodiment, the PFC control integrated circuit (IC) 511 is configured to switch the IGBT 520 and the IGBT 531 according to various inputs, so that the PFC control integrated circuit (IC) 511 controls an output. The alternate current voltage AC input from the commercial power source CP passes through the common mode choke coil 502, and the bridge diode 510 half-wave rectifies the alternate current voltage AC. At the same time, the diode 503 and the diode 504 half-wave rectify the alternate current voltage AC together with a half portion of the bridge diode 510.

After the diode 503 and the diode 504 half-wave rectify the alternate current voltage AC, the resistor 507 and the resistor 508 divide the alternate current voltage AC. Further, the capacitor 509 smoothes and rectifies the divided voltage, so that the divided voltage is input into a start voltage input terminal of the PFC control integrated circuit (IC) 511.

In the first embodiment, the PFC control integrated circuit (IC) 511 is configured to compare the divided voltage with the reference voltage therein. When the PFC control integrated circuit (IC) 511 determines that the divided voltage exceeds the reference voltage, the PFC control integrated circuit (IC) 511 starts the control operation. It is assumed that the start voltage input terminal of the PFC control integrated circuit (IC) 511 corresponds to a sufficiently low voltage, so that the power factor correction circuit 161 is capable of receiving a universal input. A voltage divided with the resistor 505 and the resistor 506 is input into an AC input voltage terminal of the PFC control integrated circuit (IC) 511, so that the voltage becomes the signal for controlling the switching of the PFC control integrated circuit (IC) 511.

In the first embodiment, the power source supplied to the PFC control integrated circuit (IC) 511, the gate drive control circuit 541, and the gate drive control circuit 542 is input from the power source inputting portion 512 for inputting the direct current voltage of 15 V. It should be noted that the power source inputting portion 512 for inputting the direct current voltage of 15 V is an insulated power source (described later) having an input side of the direct current voltage of 0 V that is separated from frame ground (FG). Further, the PFC control integrated circuit (IC) 511 is configured to output a gate drive signal from a GD1 terminal and a GD2 terminal thereof. The gate drive circuit 541 and the gate drive circuit 542 are controlled such that a power factor becomes close to one. It should be noted that the PFC control integrated circuit (IC) 511 is widely available from many semiconductor manufactures, and a detail explanation thereof is omitted.

In the first embodiment, in the gate drive control circuit 541 and the gate drive control circuit 542, the pairs of the NPN transistor 516 and the NPN transistor 527, and the PNP transistor 517 and the PNP transistor 528 amplify a drive current of the gate drive signal, so that the IGBT 520 and the IGBT 531 are switched. After the inductor 523 and the diode 524 boost a voltage, the PFC control integrated circuit (IC) 511 controls a switching duty ratio such that the diode 524, the diode 535, and the electrolytic capacitor 536 smooth the voltage to obtain the direct current voltage of +390 V. Afterward, the resistor 537, the resistor 539, the resistor 538, and the resistor 540 divide the voltage thus output for the control operation described above.

In the first embodiment, after the resistor 539 and the resistor 540 divide the voltage, the divided voltage is input into the PFC control integrated circuit (IC) 511 as a feedback voltage. Further, after the resistor 537 and the resistor 538 divide the voltage, the divided voltage is input into the PFC control integrated circuit (IC) 511 as an excess voltage detection voltage. According to a variance in an inverter load (described later), the PFC control integrated circuit (IC) 511 adjusts the switching duty ratio such that the output voltage is constantly maintained at +390 V. Further, a voltage generated from an electrical current flowing through the temperature detecting resistor 522 and the temperature detecting resistor 532 is input into the PFC control integrated circuit (IC) 511. When the detection voltage exceeds a specific threshold value, the PFC control integrated circuit (IC) 511 performs an operation such as terminating the switching and the like.

As described above, FIG. 5 is the circuit diagram showing the power source inputting portion 512 for inputting the direct current (DC) voltage of 15 V of the image forming apparatus 100 according to the first embodiment of the present invention. As described above, the power source inputting portion 512 is configured as the DC-DC converter in which the primary side and the secondary side are insulated with the transformer 609, so that the power source inputting portion 512 outputs the direct current voltage of 24 V and the direct current voltage of 15 V. It should be noted that the DC-DC converter is a flyback converter of a self communication type.

In the first embodiment, the resistor 616 and the resistor 617 divide a voltage, and the divided voltage is input into a reference terminal of the Shunt regulator 614. When the output voltage exceeds 15 V, an electrical current flows from a cathode to an anode of the Shunt regulator 614, so that an electrical current flows in a light emitting diode of the photo-coupler 610 on a secondary side thereof. Further, an electrical current flows through a primary side of the photo-coupler 610, so that a base electrical current of the NPN transistor 602 is decreased, thereby performing a constant voltage control. A further detail explanation of the power source inputting portion 512 is omitted.

As described above, FIG. 6 is the circuit diagram showing the configuration of the switching portion 163 of the DC-AC inverter 162 of the image forming apparatus 100 according to the first embodiment of the present invention. When a signal from the inverter control portion 164 is input into the switching portion 163, the switching portion 163 switches the IGBT 707, the IGBT 717, the IGBT 727, and the IGBT 737, so that the direct current voltage 390 V is switched to obtain an alternate current output. It should be noted that the IGBT 707, the IGBT 717, the IGBT 727, and the IGBT 737 may be formed of a device such as a silicon FET (Si FET), a silicon carbide FET (SiC FET), a gallium nitride FET (GaN FET), and the like.

In the first embodiment, substantially inverted signals are input with respect to upper and lower pairs of the IGBT 707, the IGBT 717, the IGBT 727, and the IGBT 737, so that a through current does not flow when the upper pair and the lower pair are concurrently turned on. Further, when the signals are completely inverted signals, a dead time is set as a period of time when the upper pair and the lower pair are concurrently turned off. Accordingly, it is possible to prevent a period of time when the upper pair and the lower pair are concurrently turned on due to a delay of the off time.

In the first embodiment, the upper and lower pair of the IGBT 707 and the IGBT 717 is configured to obtain an inverter output together with the upper and lower pair of the IGBT 727 and the IGBT 737. When the output is turned off, the same signal as that of the upper and lower pair of the IGBT 727 and the IGBT 737 is input into the upper and lower pair of the IGBT 707 and the IGBT 717. Further, the upper and lower pair of the IGBT 727 and the IGBT 737 switches the voltage of +390 V and 0 V to a connecting point of an emitter of the IGBT 727 and a collector of the IGBT 737. After the upper and lower pair of the IGBT 727 and the IGBT 737 switches the voltage, the LC filter formed of the inductor 761 and the capacitor 762 removes a high frequency component of a switching frequency component of the voltage, and then the voltage is supplied to the heater 132.

In the first embodiment, the gate driving photo-coupler 704, the gate driving photo-coupler 714, the gate driving photo-coupler 724, and the gate driving photo-coupler 734 includes a gate driver IC insulated with a photo-coupler such as TLP251 (a product of Toshiba Corp.). Further, the gate driving photo-coupler 704, the gate driving photo-coupler 714, the gate driving photo-coupler 724, and the gate driving photo-coupler 734 receive power through the power source inputting portion 701, the power source inputting portion 711, and the power source inputting portion 721 for inputting the DC voltage of 15 V. A power source of the gate driving photo-coupler 704, the gate driving photo-coupler 714, the gate driving photo-coupler 724, and the gate driving photo-coupler 734 may have a configuration similar to that shown in FIG. 5, and is disposed at three locations corresponding to the power source inputting portion 701, the power source inputting portion 711, and the power source inputting portion 721. It should be noted that the power source inputting portion 711 for inputting the DC voltage of 15 V may be shared with the power source inputting portion 512 for inputting the DC voltage of 15 V. However, the power source inputting portion 701 and the power source inputting portion 721 are insulated power sources of high-side drive circuits, and need to be insulated, respectively. It should be noted that the insulated power source of the gate drive circuit is not limited to that in the first embodiment, and may be one of other various configurations.

In the first embodiment, the N-channel field effect transistor (FET) 703, the N-channel field effect transistor (FET) 713, the N-channel field effect transistor (FET) 723, and the N-channel field effect transistor (FET) 733 are switched according to the PWM signal output from the inverter control portion 164, so that an electrical current flows through the light emitting diodes of the gate driving photo-coupler 704, the gate driving photo-coupler 714, the gate driving photo-coupler 724, and the gate driving photo-coupler 734 on the primary side thereof. Further, the gate drive circuits of the gate driving photo-coupler 704, the gate driving photo-coupler 714, the gate driving photo-coupler 724, and the gate driving photo-coupler 734 on the secondary side thereof are driven.

In the first embodiment, the current transformer 751 is configured to convert an electrical current flowing through the primary side thereof connected to the inverter circuit to a voltage on the secondary side thereof, so that the current transformer 751 outputs the voltage. The current transformer 751 has, for example, one turn on the primary side and 100 to 200 turns on the secondary side. The resistor 752 converts the output of the current transformer 751 on the secondary side to the voltage, and the diode 753 smoothes the voltage. Further, the resistor 754, the resistor 755, and the capacitor 756 rectify the voltage, so that the voltage is output as the direct current voltage.

As described above, FIG. 7 is the block diagram showing the configuration of the inverter controlling portion 164 of the DC-AC inverter 162 of the image forming apparatus 100 according to the first embodiment of the present invention.

As shown in FIG. 7, the DC-AC inverter 162 outputs a PWM_A signal from the PWM output terminal 803, a PWM_B signal from the PWM output terminal 804, a PWM_C signal from the PWM output terminal 805, and a PWM_D signal from the PWM output terminal 806 according to the signal transmitted from the printer engine control portion 143. More specifically, the printer engine control portion 143 transmits the signal indicating an instruction to turn on or off the application of the voltage to the heater 132. Further, the inverter control portion 164 identifies wave shapes of the PWM_A signal, the PWM_B signal, the PWM_C signal, and the PWM_D signal according to the signal transmitted from the printer engine control portion 143, so that the inverter control portion 164 outputs from the corresponding PWM terminal. It should be noted that the inverter control portion 164 is disposed on the inverter side, and may be configured such that the PWM signal is directly output from the large scale integrated circuit of the printer engine control portion 143.

In the first embodiment, the output voltage of the DC-AC inverter 162 is determined according to the PWM_A signal, the PWM_B signal, the PWM_C signal, and the PWM_D signal. More specifically, the inverter control portion 164 receives an attribution value representing a variance in the resistivity value of the heater 132 from the data holding portion 134, and adjusts the output voltage of the DC-AC inverter 162 according to the attribution value, thereby maintaining power consumption of the heater 132 at a constant level. Further, the inverter control portion 164 is configured to reset the PWM signal to be output at an edge of a zero cross signal input thereto, so that a rise of an output sine wave voltage is synchronized with the zero cross signal. Further, the inverter control portion 164 is configured to restrict the duty ratio of the PWM signal according to a level of an inverter current converted to a voltage and indicated with a voltage ADC_A input into the ADC_A input terminal 807.

Figure 8:
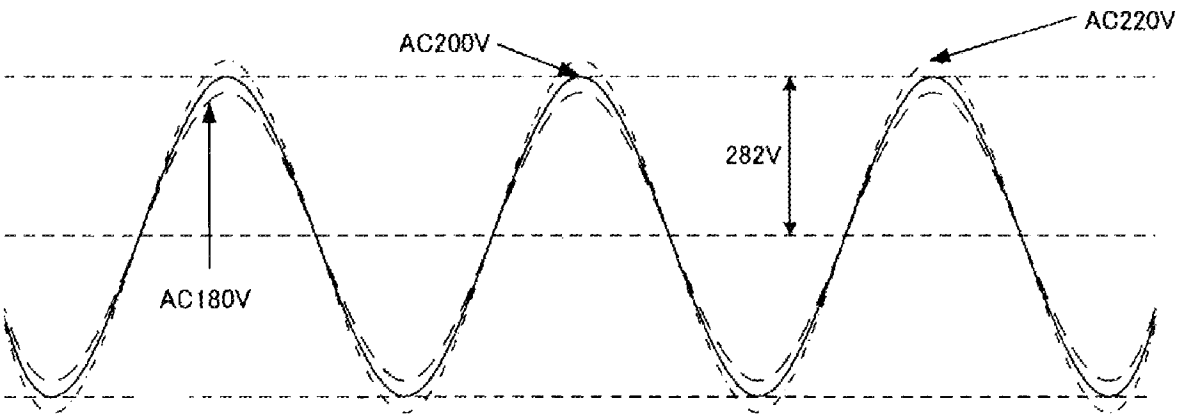
FIGS. 8(A) and 8(B) are graphs showing schematic inverter output wave shapes of the DC-AC inverter of the image forming apparatus according to the first embodiment of the present invention.
Figure 8:
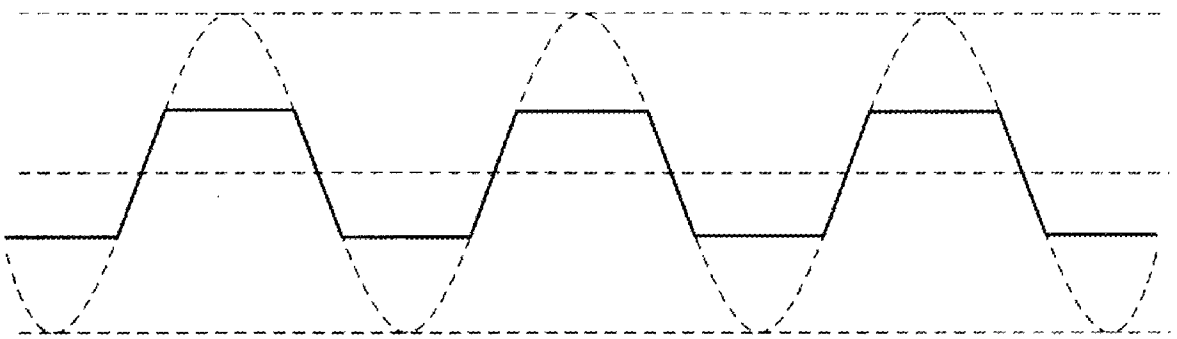

FIGS. 8(A) and 8(B) are graphs showing schematic inverter output wave shapes of the DC-AC inverter 162 of the image forming apparatus 100 according to the first embodiment of the present invention.

In the first embodiment, the inverter control portion 164 retrieves the attribution value indicating the variance in the resistivity value of the heater 132 from the data holding portion 134 at a specific timing determined in advance, for example, when the image forming apparatus 100 is turned on, a cover is closed or opened, and the like. The attribution value indicates the variance in the resistivity value of the heater 132. When the variance in the resistivity value of the heater 132 is ±10%, for example, the attribution value is between 0.9 and 1.1. In this case, the attribution value is a ratio between the resistivity value of the heater 132 relative to the standard value of the resistivity value of the heater 132. Accordingly, the attribution value increases when the resistivity value of the heater 132 increases.

In the first embodiment, the inverter control portion 164 is configured to adjust or correct the output voltage of the DC-AC inverter 162 through multiplying the attribution value by the PWM duty ratio of the inverter output, or further multiplying by a coefficient determined through an experiment in advance. Accordingly, when the attribution value increases, the output voltage of the DC-AC inverter 162 is increased.

In the first embodiment, when the attribution value is 1, that is, there is no adjustment or correction, the DC-AC inverter 162 outputs the alternate current voltage of 200 V (AC 200 V) represented with a solid line in FIG. 8(A). When the attribution value is 0.9, the DC-AC inverter 162 outputs the alternate current voltage of 180 V (AC 180 V) represented with a projected line in FIG. 8(A). When the attribution value is 1.1, the DC-AC inverter 162 outputs the alternate current voltage of 220 V (AC 220 V) represented with a phantom line in FIG. 8(A). Accordingly, it is possible to apply the voltage with the variance of ±10% to the heater 132 with the rated alternate current voltage of 200 V. As a result, even when the resistivity of the heater 132 is fluctuated, it is possible to maintain the same output.

FIG. 8(B) is a graph showing schematic inverter output wave shapes of the DC-AC inverter 162 of the image forming apparatus 100 when the electrical current is restricted. When the resistivity value of the heater 132 is low during an initial period after the heater 132 is energized, the inverter control portion 164 restricts the PWM duty ratio when the electrical current represented with the voltage ADC_A exceeds the threshold value determined in advance. Accordingly, a peak of the alternate current voltage is restricted, and the voltage with the restricted wave shape is output until the temperature of the heater 132 is increased and the resistivity value thereof is dropped.

FIGS. 9(A) to 9(D) are graphs showing schematic output wave shapes of the pulse width modulation (PWM) signals of the DC-AC inverter 162 of the image forming apparatus 100 according to the first embodiment of the present invention.

Figure 9:
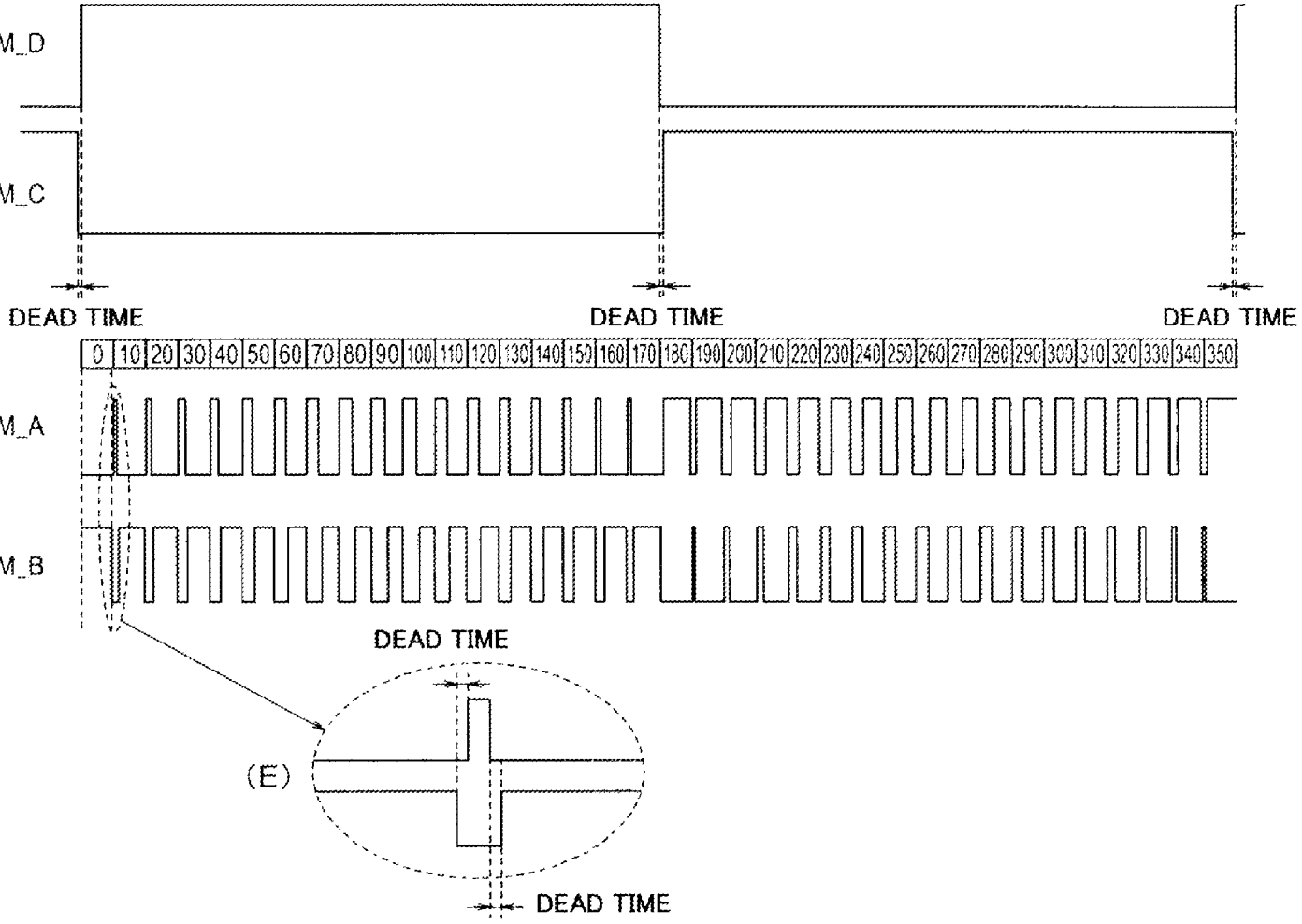
FIGS. 9(A) to 9(D) are graphs showing schematic output wave shapes of pulse width modulation (PWM) signals of the DC-AC inverter of the image forming apparatus according to the first embodiment of the present invention.

In the first embodiment, the PWM_C signal or the PWM_D signal is input into the bridges at two locations on one side of the IGBT full bridge. As shown in FIGS. 9(A) and 9(B), the PWM_C signal and the PWM_D signal have PWM wave shapes of output sine wave cycles that are inverted with respect to the upper and lower pair. Further, the PWM_A signal or the PWM_B signal is input into the bridges at two locations on the other side of the IGBT full bridge. As shown in FIGS. 9(C) and 9(D), the PWM_A signal and the PWM_B signal have PWM wave shapes to adjust the duty ratio according to the output sine wave cycles. It should be noted that the inverter control portion 164 may be configured to calculate the PWM duty ratio through calculating a trigonometric function in real time, or a table storing the duty ration determined in advance may be stored in a memory (not shown) and the like. The inverter wave shape output is well known, and a detailed explanation thereof is omitted.

FIGS. 10(A) to 10(D) are graphs for explaining a first wave shape of the DC-AC inverter 162 of the image forming apparatus 100 when the electrical current is restricted according to the first embodiment of the present invention. It should be noted that wave shapes shown in FIGS. 10(A) to 10(D) are correspond to left halves of the wave shapes shown in FIGS. 9(A) to 9(D).

Figure 10:
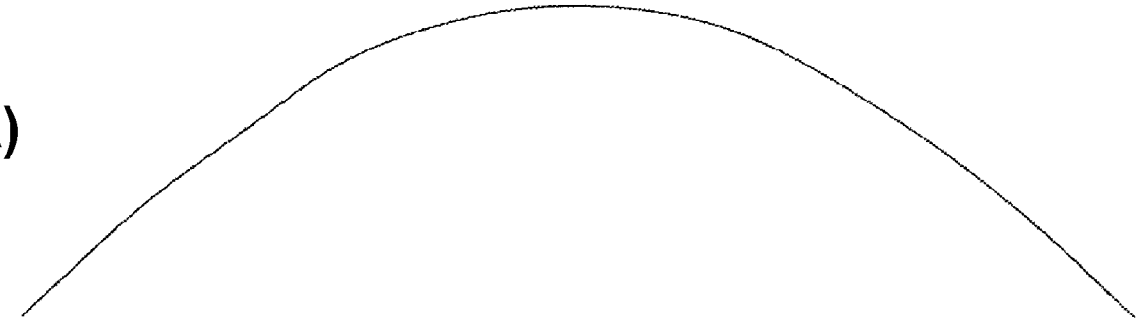
FIGS. 10(A) to 10(D) are graphs for explaining a first wave shape of the DC-AC inverter of the image forming apparatus when an electrical current is restricted according to the first embodiment of the present invention.
Figure 10:
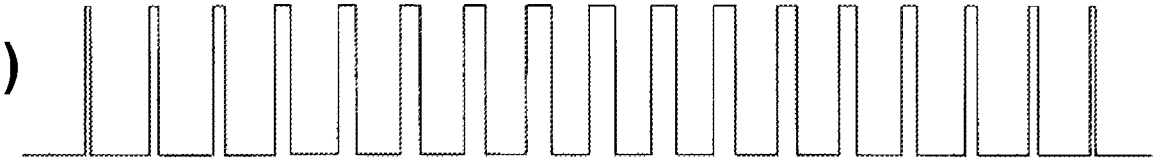
Figure 10:
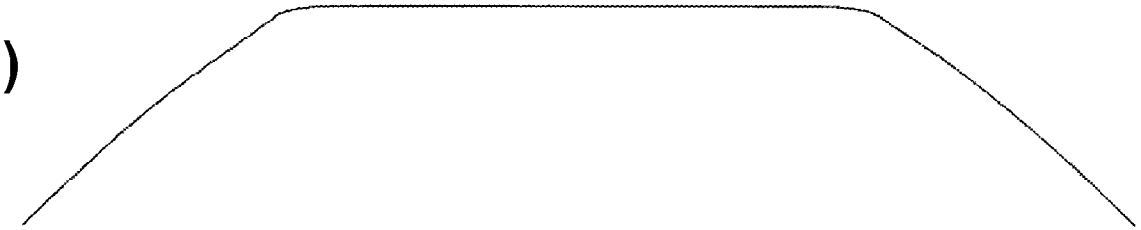
Figure 10:
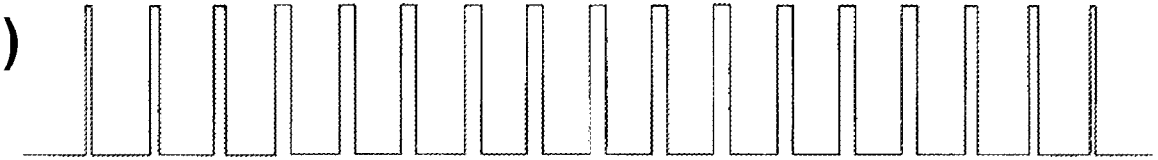

FIG. 10(A) is a graph showing a wave shape of the PWM_A signal, and FIG. 10(B) is a graph showing a wave shape of the output sine wave of the DC-AC inverter 162 when the PWM_A signal having the wave shape shown in FIG. 10(A) is output. It should be noted that the PWM_B signal has an inverted wave shape of the wave shape of the PWM_A signal and the dead time is added to the inverted wave shape.

In the first embodiment, the input voltage of the ADC_A input terminal 807 is changed according to the electrical current flowing through the current transformer 751. When the input voltage of the ADC_A input terminal 807 exceeds a threshold value determined in advance, the inverter control portion 164 restricts a pulse width of the PWM_A signal as shown in FIG. 10(D). More specifically, the inverter control portion 164 restricts the pulse width of the PWM_A signal not to be enlarged further. Accordingly, as shown in FIG. 10(C), the output wave has a trapezoid shape with a flat peak.

Figure 11:
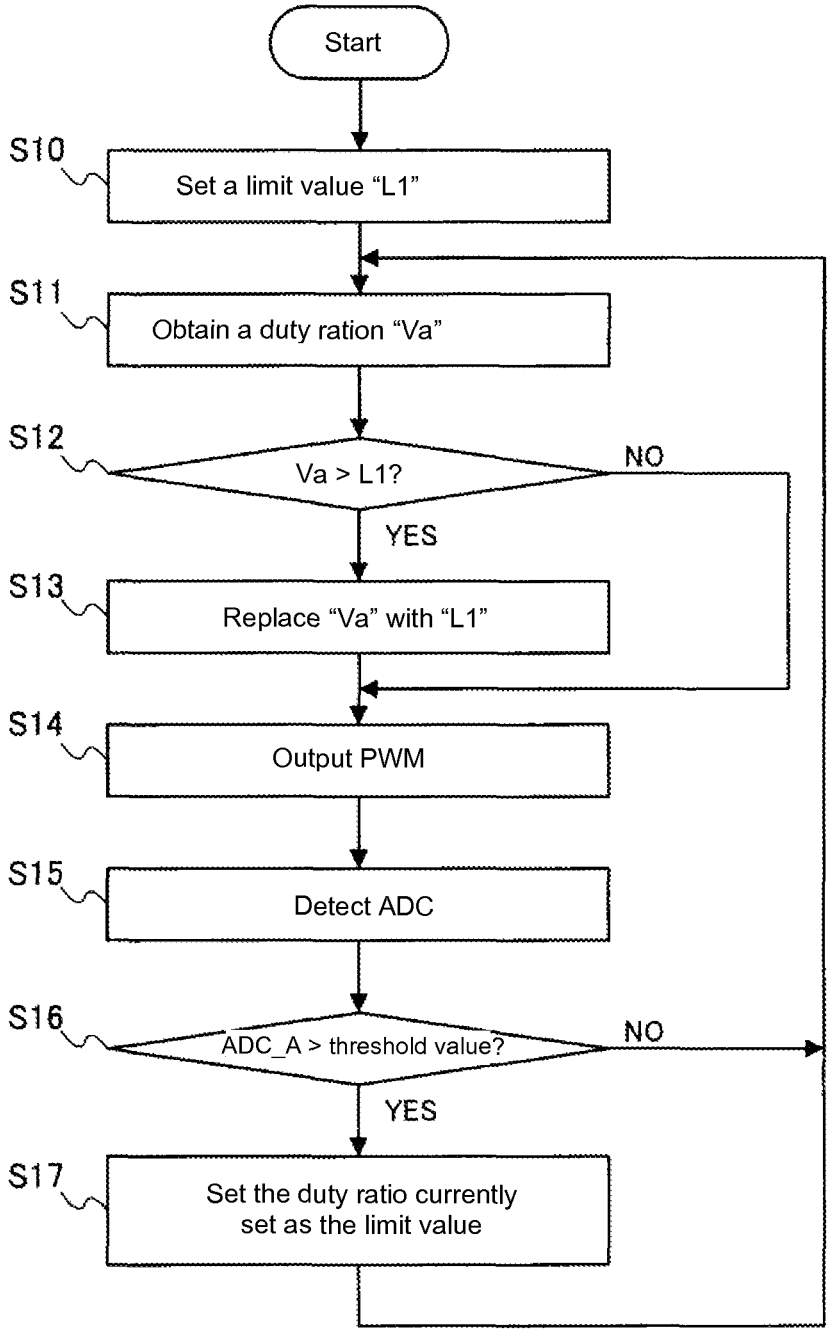
FIG. 11 is a flow chart showing a first process of the image forming apparatus when an output voltage from the DC-AC inverter is restricted according to the first embodiment of the present invention.

FIG. 11 is a flow chart showing a first process of the image forming apparatus 100 when the output voltage from the DC-AC inverter 162 is restricted according to the first embodiment of the present invention. More specifically, FIG. 11 is a flow chart in the case shown in FIGS. 10(A) to 10(D).

In step S10, the inverter control portion 164 sets an initial value to a limit value "L1" of the duty ratio of the PWM signal. In the first embodiment, the power factor correction circuit 161 outputs the direct current voltage of 390 V. Accordingly, when the duty ratio becomes one, the output voltage from the DC-AC inverter 162 exceeds the rated value of 200 V. For this reason, the inverter control portion 164 sets the maximum duty ratio for outputting a voltage with the rated value as the initial value.

In step S11, the inverter control portion 164 obtains a duty ratio "Va" of the PWM_A signal to be output to the switching portion 163 next. For example, the duty ratio for outputting the alternate current voltage of 200 V as the rated value may be stored in a table in advance. Alternatively, the duty ratio may be calculated with a trigonometric function. In step S12, the inverter control portion 164 determines whether the duty ratio "Va" thus obtained is greater than the limit value "L1". When the inverter control portion 164 determines that the duty ratio "Va" thus obtained is greater than the limit value "L1" (YES in step S12), the process proceeds to step S13. When the inverter control portion 164 determines that the duty ratio "Va" thus obtained is smaller than the limit value "L1" (NO in step S12), the inverter control portion 164 sets the duty ratio "Va" thus obtained as the duty ratio currently set, and the process proceeds to step S14.

In step S13, the inverter control portion 164 replaces the duty ratio "Va" thus obtained with the limit value "L", so that the limit value "L1" is set as the duty ratio currently set. Afterward, the process proceeds to step S14. In step S14, the inverter control portion 164 outputs the PWM signal according to the duty ratio currently set. In this case, the duty ratio currently set is corrected according to the attribution value of the heater 132.

In step S15, the inverter control portion 164 detects the input voltage of the ADC_A input terminal 807. In step S16, the inverter control portion 164 determines whether the input voltage of the ADC_A input terminal 807 is greater than a threshold value determined in advance. When the inverter control portion 164 determines that the input voltage of the ADC_A input terminal 807 is greater than the threshold value determined in advance (YES in step S16), the process proceeds to step S17. When the inverter control portion 164 determines that the input voltage of the ADC_A input terminal 807 is smaller than the threshold value determined in advance (NO in step S16), the process returns to step S11. In step S17, the inverter control portion 164 sets the duty ratio currently set as the limit value "L1", and the process returns to step S11.

FIGS. 12(A) to 12(D) are graphs for explaining a second wave shape of the DC-AC inverter 162 of the image forming apparatus 100 when the electrical current is restricted according to the first embodiment of the present invention. It should be noted that wave shapes shown in FIGS. 12(A) to 12(D) are correspond to right halves of the wave shapes shown in FIGS. 9(A) to 9(D).

Figure 12:
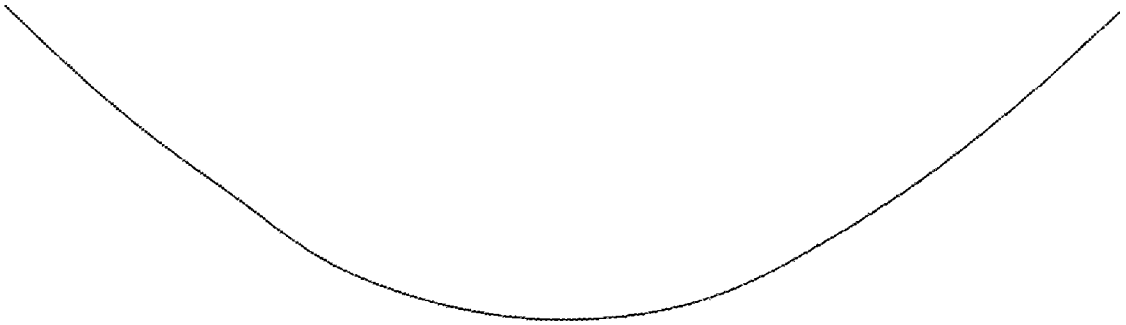
FIGS. 12(A) to 12(D) are graphs for explaining a second wave shape of the DC-AC inverter of the image forming apparatus when an electrical current is restricted according to the first embodiment of the present invention.
Figure 12:
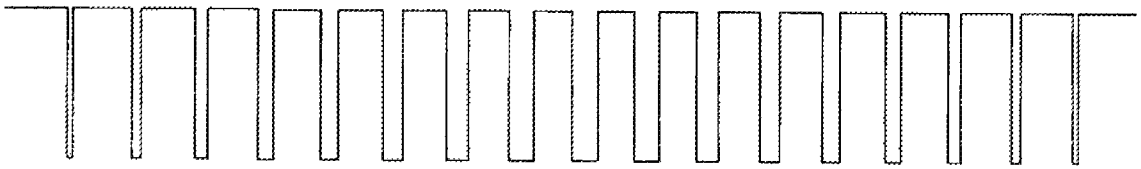
Figure 12:
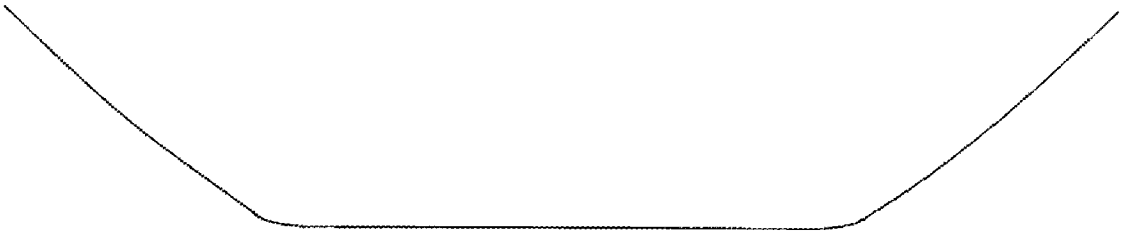
Figure 12:
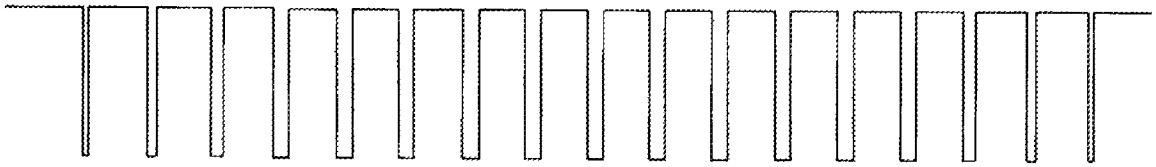

FIG. 12(A) is a graph showing a wave shape of the PWM_A signal, and FIG. 12(B) is a graph showing a wave shape of the output sine wave of the DC-AC inverter 162 when the PWM_A signal having the wave shape shown in FIG. 12(A) is output. It should be noted that the PWM_B signal has an inverted wave shape of the wave shape of the PWM_A signal and the dead time is added to the inverted wave shape.

In the first embodiment, the input voltage of the ADC_A input terminal 807 is changed according to the electrical current flowing through the current transformer 751. When the input voltage of the ADC_A input terminal 807 exceeds a threshold value determined in advance, the inverter control portion 164 restricts a pulse width of the PWM_A signal as shown in FIG. 12(D). More specifically, the inverter control portion 164 restricts the pulse width of the PWM_A signal not to be enlarged further. Accordingly, as shown in FIG. 12(C), the output wave has a trapezoid shape with a flat peak.

Figure 13:
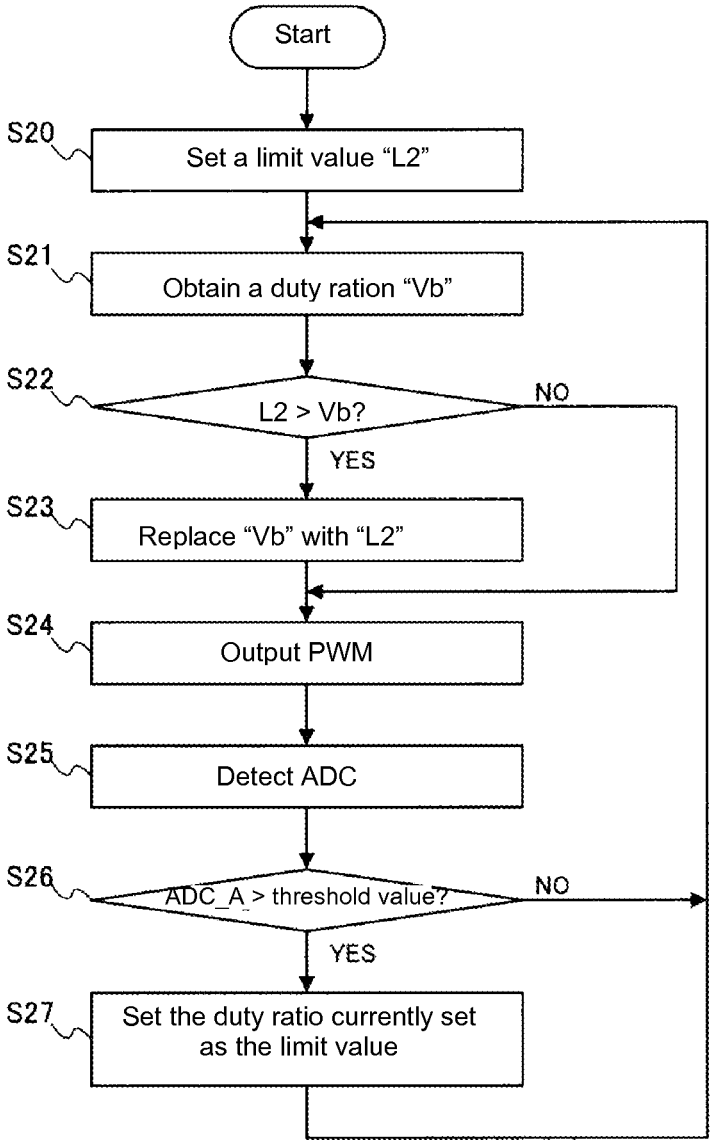
FIG. 13 is a flow chart showing a second process of the image forming apparatus when the output voltage from the DC-AC inverter is restricted according to the first embodiment of the present invention.

FIG. 13 is a flow chart showing a second process of the image forming apparatus 100 when the output voltage from the DC-AC inverter 162 is restricted according to the first embodiment of the present invention. More specifically, FIG. 11 is a flow chart in the case shown in FIGS. 12(A) to 12(D).

In step S20, the inverter control portion 164 sets an initial value to a limit value "L2" of the duty ratio of the PWM signal. In the first embodiment, the power factor correction circuit 161 outputs the direct current voltage of 390 V. Accordingly, when the duty ratio becomes one, the output voltage from the DC-AC inverter 162 exceeds the rated value of 200 V. For this reason, the inverter control portion 164 sets the minimum duty ratio for outputting a voltage with the rated value as the initial value.

In step S21, the inverter control portion 164 obtains a duty ratio "Vb" of the PWM_A signal to be output to the switching portion 163 next. In step S22, the inverter control portion 164 determines whether the duty ratio "Vb" thus obtained is smaller than the limit value "L2". When the inverter control portion 164 determines that the duty ratio "Vb" thus obtained is smaller than the limit value "L2" (YES in step S22), the process proceeds to step S23. When the inverter control portion 164 determines that the duty ratio "Va" thus obtained is greater than the limit value "L1" (NO in step S22), the inverter control portion 164 sets the duty ratio "Va" thus obtained as the duty ratio currently set, and the process proceeds to step S24.

In step S23, the inverter control portion 164 replaces the duty ratio "Vb" thus obtained with the limit value "L2", so that the limit value "L2" is set as the duty ratio currently set. Afterward, the process proceeds to step S24. In step S24, the inverter control portion 164 outputs the PWM signal according to the duty ratio currently set. In this case, the duty ratio currently set is corrected according to the attribution value of the heater 132.

In step S25, the inverter control portion 164 detects the input voltage of the ADC_A input terminal 807. In step S26, the inverter control portion 164 determines whether the input voltage of the ADC_A input terminal 807 is greater than a threshold value determined in advance. When the inverter control portion 164 determines that the input voltage of the ADC_A input terminal 807 is greater than the threshold value determined in advance (YES in step S26), the process proceeds to step S27. When the inverter control portion 164 determines that the input voltage of the ADC_A input terminal 807 is smaller than the threshold value determined in advance (NO in step S26), the process returns to step S21. In step S27, the inverter control portion 164 sets the duty ratio currently set as the limit value "L2", and the process returns to step S21.

In the first embodiment, on the left side of the wave shapes of the PWM signals shown in FIGS. 9(A) to 9(D), a region of a logic product (AND) of the PWM_D signal and the PWM_A signal corresponds to a period of time when the heater 132 is turned on. Further, on the right side of the wave shapes of the PWM signals shown in FIGS. 9(A) to 9(D), a region of a logic product (AND) of the PWM_C signal and the PWM_D signal corresponds to a period of time when the heater 132 is turned on. Accordingly, over one cycle shown in FIGS. 9(A) to 9(D), the electrical current flows in an X direction in FIG. 6 during the first half thereof, and the electrical current flows in a Y direction in FIG. 6 during the first half thereof.

In the first embodiment, when the inverter control portion 164 is formed of a micro computer or a logic circuit, the inverter control portion 164 controls the PWM_A signal, and sets the dead time to the inverted output of the PWM_B signal. Accordingly, the process proceeds through the flow charts shown in FIG. 11 and FIG. 13, and the present invention is not limited thereto. Further, the heater 132 is the load, so that it is suffice to suppress only the peak when the electrical current is restricted. It should be noted that, although the wave shape is deformed somehow, no adverse effect is expected since the heater 132 is a resistor-type load.

In the first embodiment, the heater 132 is the load, and the resistivity value of the heater 132 is increased due to the increase in the temperature thereof once the heater 132 is turned on. Accordingly, it is configured such that the duty ratio is clamped when the electrical current exceeds the threshold value determined in advance.

In the conventional configuration, a triac is provided for controlling a phase. In is known that the triac is turned on only at the zero cross point (the voltage becomes zero). Accordingly, when it is tried to restrict the electrical current, it is possible to control only through an estimate at the initial power on.

On the other hand, in the first embodiment, the electrical current is restricted through switching. Accordingly, it is possible to restrict the electrical current immediately when the excess electrical current is detected. Further, when the output is switched, the PWM duty ratio is gradually increased from the output zero cross point to obtain the sine wave output. Accordingly, only the small electrical current flows into the heater 132 upon starting to turn on the heater 132, and it is possible to prevent the excessive electrical current significantly above the threshold value from flowing.

In the conventional configuration, until the heater is warmed up, the phase control is performed for a specific period of time so that an excessive electrical current does not flow. Afterward, the heater is energized continuously, and firmware of the printer engine control portion controls power of the heater.

On the other hand, in the first embodiment, the limit is applied to the electrical current on the power source side. Accordingly, it is possible to achieve the maximum value of the electrical current while monitoring the electrical current all the time. As a result, it is possible to quickly raise the heater 132 even when started at a cold start. It should be noted that the threshold value of the maximum electrical current upon switching may be de determined according to the electrical current, the switching frequency, the operation temperature, and the like based on the stable operation region of the IGBT, that is, the switching device.

As described above, in the first embodiment, regardless of the input voltage of the commercial power source CP, the DC-AC inverter 162 controls power supplied to the heater 132. While monitoring the electrical current of the DC-AC inverter 162, when the excessive electrical current is detected, the electrical current is restricted. Accordingly, it is possible to raise the heater 132 for a short period of time whiling suppressing an inrush current. Moreover, it is possible to minimize conductive noise and an influence of flicker.

Further, in the first embodiment, the variance in the resistivity of the heater 132 is corrected, and the DC-AC inverter 162 outputs. Accordingly, it is possible to minimize the variance in the temperature rising time and the power consumption due to the fluctuation of the input voltage of the commercial power source, the variance in the resistivity of the heater 132, and the like. Further, it is possible to deal with the commercial power source with the input voltage between 80 V and 260 V only for the alternate current voltage of 200 V, so that it is not necessary to provide the heater 132 with various types according to the specification.

Second Embodiment

A second embodiment of the present invention will be explained next. In the second embodiment, an image forming apparatus 200 has a configuration similar to that of the image forming apparatus 100 in the first embodiment shown in FIG. 1.

As shown in FIG. 1, the image forming apparatus 200 includes the toner cartridges 101; the LED heads 102; the developing units 110; the transfer rollers 103; the sheet cassette 104; the hopping roller 105; and the register rollers 106. Further, the image forming apparatus 200 includes the sheet detection sensor 107; the transfer belt 108; the drive roller 120; the follower roller 121; the transfer belt cleaning blade 122; the cleaner container 123; a fixing device 230; the sheet guide 124; and the sheet discharge tray 125. It should be noted that the image forming apparatus 200 includes the fixing device 230 having a configuration different from the fixing device 130 of the image forming apparatus 100.

As shown in FIG. 2, the control system of the image forming apparatus 200 includes the host interface portion 140; the command image processing portion 141; the LED head interface portion 142; and the printer engine control portion 143. It should be noted that the control system of the image forming apparatus 200 in the second embodiment has a configuration similar to that of the control system of the image forming apparatus 100 in the first embodiment, except that the control system of the image forming apparatus 200 includes the printer engine control portion 143 that controls the fixing device 230 and a low voltage power source 260.

Figure 14:
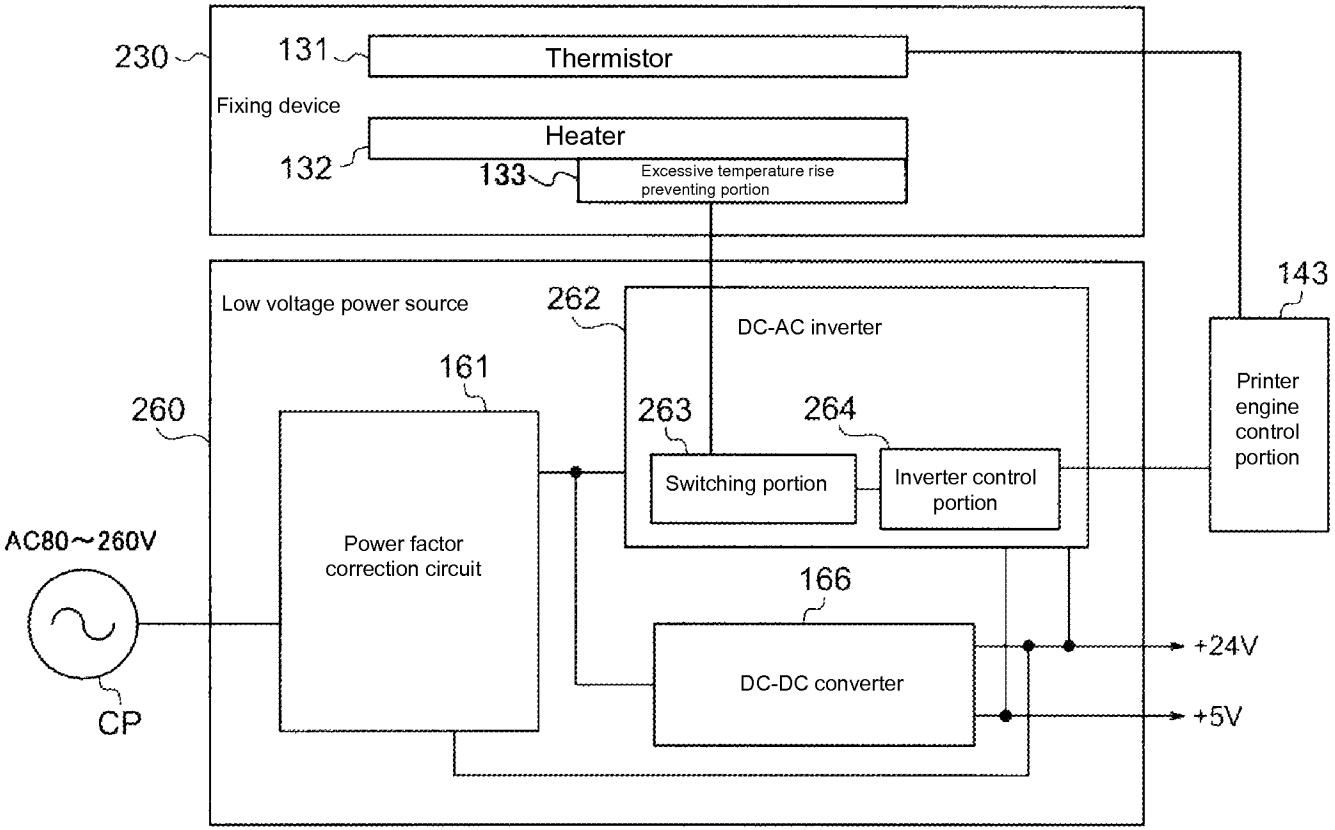
FIG. 14 is a block diagram showing configurations of a fixing device and a low voltage power source of an image forming apparatus according to a second embodiment of the present invention.

FIG. 14 is a block diagram showing configurations of the fixing device 230 and the low voltage power source 260 of the image forming apparatus 200 according to the second embodiment of the present invention.

As shown in FIG. 14, the fixing device 230 includes the thermistor 131; the heater 132; and the excessive temperature rise preventing portion 133. It should be noted that the fixing device 230 has the configuration similar to that of the fixing device 130 in the first embodiment, except that the fixing device 230 does not have the data holding portion 134.

In the second embodiment, the low voltage power source 260 includes the power factor correction circuit 161; a DC-AC inverter 262; and the DC-DC converter 166. It should be noted that the low voltage power source 260 has the configuration similar to that of the low voltage power source 160 in the first embodiment, except that the DC-AC inverter 262 has a configuration different from that of the DC-AC inverter 162 in the first embodiment.

In the second embodiment, the DC-AC inverter 262 includes a switching portion 263 and an inverter control portion 264. With the configuration described above, the DC-AC inverter 262 converts the direct current (DC) voltage to the alternate current (AC) voltage having a desirable level to be applied to the heater 132. It should be noted that the DC-AC inverter 262 adjusts the alternate current (AC) voltage thus generated according to a value of an electrical current flowing through the switching portion 263, so that power consumption of the heater 132 is maintained at a constant level.

Figure 15:
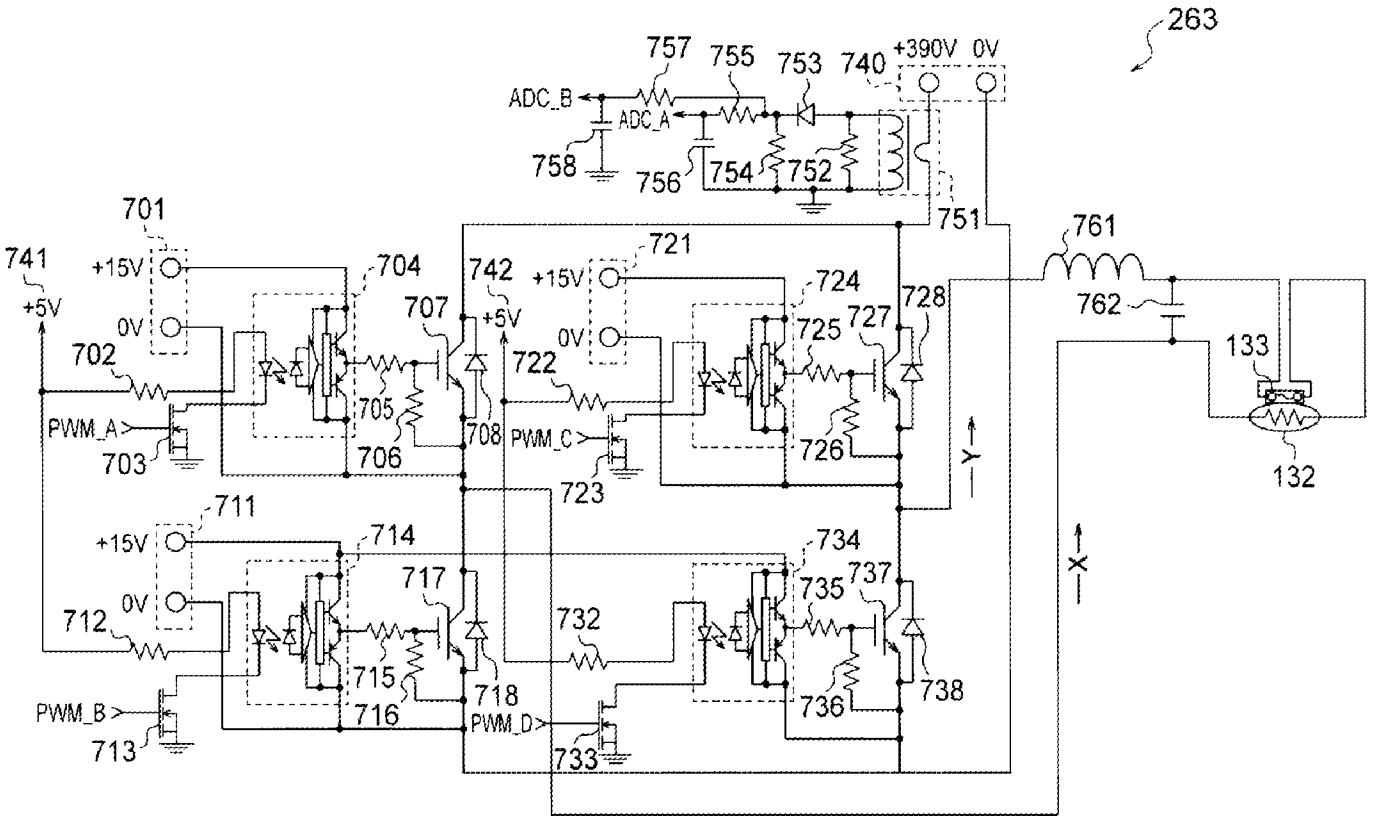
FIG. 15 is a circuit diagram showing a configuration of a switching portion of a DC-AC inverter of the image forming apparatus according to the second embodiment of the present invention.

FIG. 15 is a circuit diagram showing a configuration of the switching portion 263 of the DC-AC inverter 262 of the image forming apparatus 200 according to the second embodiment of the present invention.

As shown in FIG. 15, the switching portion 263 includes a resistor 757 and a capacitor 758. It should be noted that the switching portion 263 has the configuration similar to that of the switching portion 163 in the first embodiment, except that the switching portion 263 outputs a voltage ADC_B to the inverter control portion 264.

In the second embodiment, the switching portion 263 includes a first electrical current detecting portion for detecting the electrical current flowing through the switching portion 163, and a second electrical current detecting portion for detecting the electrical current flowing through the switching portion 163. It should be noted that the current transformer 751, the resistor 752, the diode 753, the resistor 754, the resistor 755, the capacitor 756, and the capacitor 758 constitute the first electrical current detecting portion. Further, the current transformer 751, the resistor 752, the diode 753, the resistor 754, the resistor 755, and the capacitor 756 constitute the second electrical current detecting portion.

Figure 16:
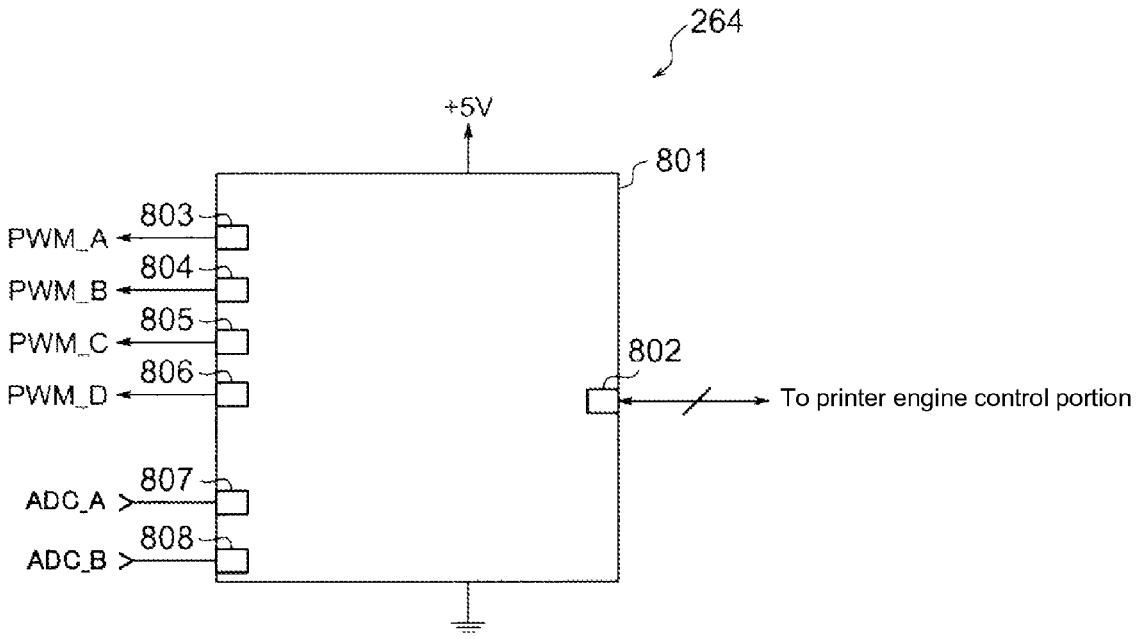
FIG. 16 is a block diagram showing a configuration of an inverter controlling portion of the DC-AC inverter of the image forming apparatus according to the second embodiment of the present invention.

FIG. 16 is a block diagram showing a configuration of the inverter controlling portion 264 of the DC-AC inverter 262 of the image forming apparatus 200 according to the second embodiment of the present invention. It should be noted that the inverter control portion 264 has the configuration similar to that of the inverter control portion 164 in the first embodiment, except that the inverter control portion 264 further includes an ADC_B input terminal 808.

An operation of the image forming apparatus 200 will be explained next. It should be noted that an explanation of an operation of the image forming apparatus 200 similar to that of the image forming apparatus 100 in the first embodiment is omitted.

As shown in FIG. 15, the current transformer 751 of the switching portion 263 is connected to two outputs, i.e., the ADC_A input terminal 807 and the ADC_B input terminal 808.

Further, an RC filer of a shutout frequency is connected to an output to the ADC_A input terminal 807 used also in the first embodiment, and the RC filter is capable of detecting a variance in an electrical current at a switching frequency of the PWM_A signal and the PWM_B signal among the inverter switching frequencies. Additionally, in the second embodiment, an RC filer of a low shutout frequency is disposed for detecting a variance in an electrical current at a switching frequency of the PWM_C signal and the PWM_D signal as the inverter output switching frequencies.

In the second embodiment, the inverter control portion 264 shown in FIG. 16 is configured to perform a sampling an output voltage at the ADC_B input terminal 808, and calculates a correction value for correcting the duty ratio of the PWM signal through calculating an average value of the electrical current. Further, the inverter control portion 264 is configured to multiply the corrected value thus calculated by the duty ratio of the PWM signal, so that the inverter control portion 264 corrects the inverter output.

Figure 17:
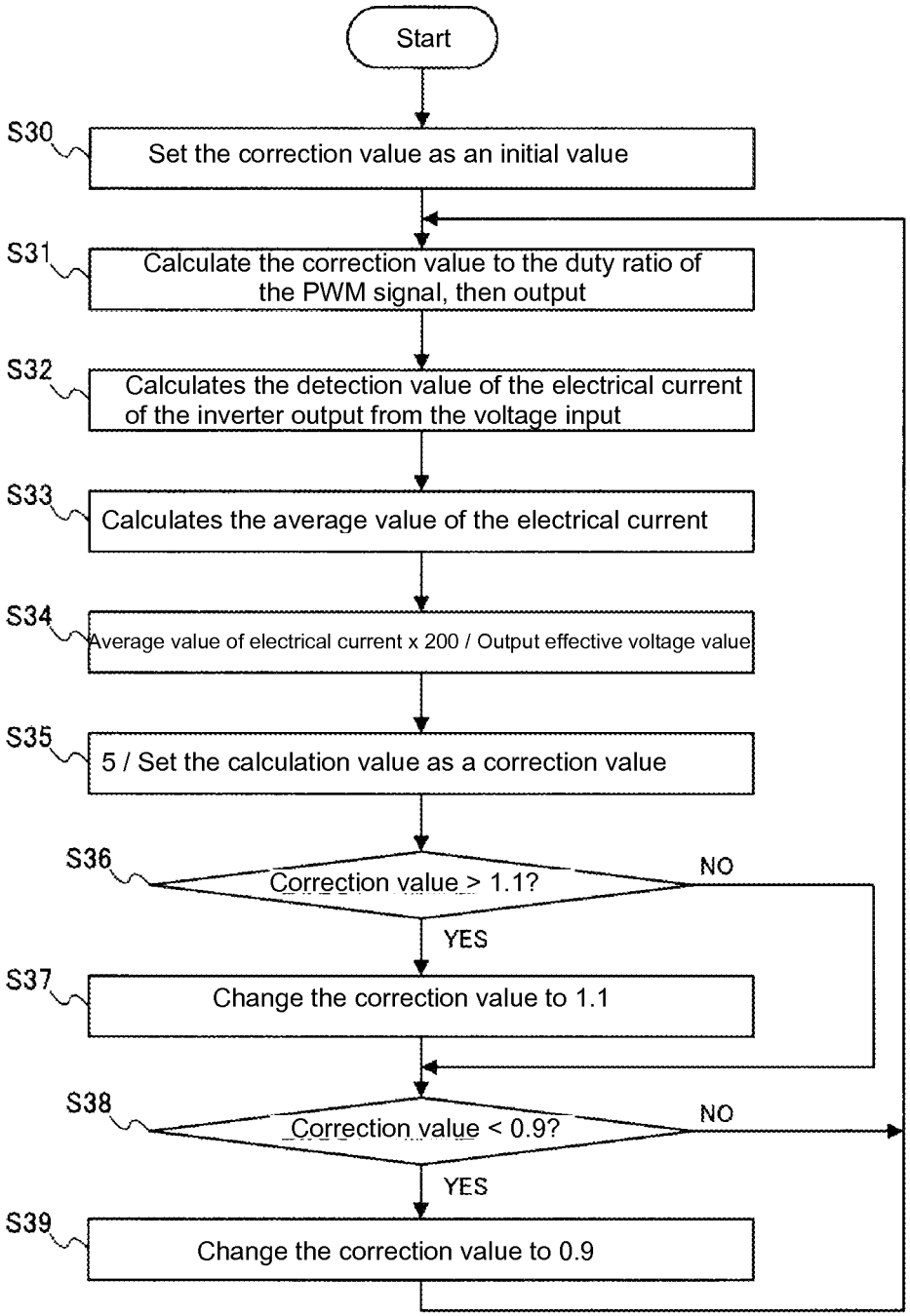
FIG. 17 is a flow chart showing an operation of the image forming apparatus when a correction value of a duty ratio of a PWM signal is calculated according to the second embodiment of the present invention.

FIG. 17 is a flow chart showing the operation of the image forming apparatus 200 when the correction value of the duty ratio of the PWM signal is calculated according to the second embodiment of the present invention. In the following description, it is assumed that the power consumption of the heater 132 is 1,000 W.

In step S30, the inverter control portion 264 sets the correction value of the duty ratio of the PWM signal as an initial value. For example, in order to output the alternate current voltage of 180 V from the DC-AC inverter 262, the initial value may be set to 0.90.

In step S31, the inverter control portion 264 calculates the correction value to the duty ratio of the PWM signal, so that the inverter control portion 264 outputs. In this case, the inverter control portion 264 multiplies the duty ratio of the PWM signal with the correction value. In step S32, the inverter control portion 264 calculates the detection value of the electrical current of the inverter output from the voltage input from the ADC_B input terminal 808. In step S33, the inverter control portion 264 calculates the average value of the electrical current, so that the inverter control portion 264 calculates the average value of the electrical current of the inverter output.

In step S34, the switching portion 263 calculates the calculation value using the average value of the electrical current calculated in step S33 according to the following equation.

Calculation value=Average value of electrical current×200/Output effective voltage value In the second embodiment, the output effective voltage value is set to 180 V in step S30. Accordingly, the calculation value obtained from the equation represents the electrical current value at the effective alternate current voltage value of 200 V.

In step S35, the inverter control portion 264 divides the reference value of the electrical current of the DC-AC inverter 262 by the calculation value calculated in step S34, so that the inverter control portion 264 sets the correction value. In step S36, the inverter control portion 264 determines whether the correction value thus set is greater than 1.1. When the inverter control portion 264 determines that the correction value thus set is greater than 1.1 (YES in step S36), the process proceeds to step S37. When the inverter control portion 264 determines that the correction value thus set is smaller than 1.1 (NO in step S36), the process proceeds to step S38. In step S37, the inverter control portion 264 changes the correction value to 1.1, and the process proceeds to step S38.

In step S38, the inverter control portion 264 determines whether the correction value thus set is smaller than 0.9. When the inverter control portion 264 determines that the correction value thus set is smaller than 0.9 (YES in step S38), the process proceeds to step S39. When the inverter control portion 264 determines that the correction value thus set is greater than 0.9 (NO in step S38), the process returns to step S31. At this moment, the output effective voltage value may be set to 200 V in the following operation. In step S39, the inverter control portion 264 changes the correction value to 0.9, and the process returns to step S31. At this moment, the output effective voltage value may be set to 200 V in the following operation.

In the second embodiment, using the correction value calculated as described above, the inverter control portion 264 corrects the duty ratio of the PWM_A signal in the left cycle, and corrects the duty ratio of the PWM_B signal in the right cycle. More specifically, during a period of time when the PWM_D signal is high, the inverter control portion 264 multiplies the duty ratio of the PWM_A signal with the correction value. During a period of time when the PWM_D signal is low, the inverter control portion 264 multiplies the duty ratio of the PWM_A signal with an inverse number of the correction value. Since the correction value is limited within the range between 0.9 and 1.1. Accordingly, the inverter control portion 264 multiplies between 0.91 (≈1/1.1) and 1.11 (≈1/0.9). As a result, when the detected electrical current increases, the voltage output from the DC-AC inverter 162 is decreased, thereby maintaining the power consumption of the heater 132 at the constant level.

Accordingly, in the second embodiment, the maximum output voltage is restricted at the alternate voltage of 180 V in the initial state. Then, the output voltage is corrected in the range between the alternate voltage of 180 V and 220 V according to the variance in the resistivity value of the heater 132. Further, the output voltage is corrected while detecting the electrical current in real time. Accordingly, when the heater 132 is 1,000 W/the alternate voltage of 200 V, it is controlled such that the effective power value becomes 1,000 W at maximum.

As described above, in the second embodiment, the output voltage of the DC-AC inverter 262 is corrected while detecting the electrical current in real time. Accordingly, it is possible to supply constant power to the heater 132 regardless of the variance in the resistivity value of the heater 132. Further, even when the power source voltage is fluctuated, it is possible to minimize the variance in power supplied to the heater 132. Accordingly, it is possible to stably supply power to the heater 132, and to correct the fluctuation of the power supply due to the variance in the resistivity value of the heater 132.

In the first embodiment and the second embodiment, the present invention is applied to the heater 132 used in the image forming apparatus 100 and the image forming apparatus 200 for forming the color image. It should be noted that the present invention may be applied to a monochrome image forming apparatus. Further, the present invention may be applied to a printer, a facsimile, a copier, and a multi function product other than the image forming apparatus 100 and the image forming apparatus 200.

The disclosure of Japanese Patent Application No. 2015-010789, filed on Jan. 23, 2015, is incorporated in the application.

While the invention has been explained with reference to the specific embodiments of the invention, the explanation is illustrative and the invention is limited only by the appended claims.

What is claimed is:

1. A heater control device, comprising:

a power factor correction circuit configured to convert an alternate current voltage from a commercial power source to a direct current voltage;

an inverter configured to generate a specific alternate current voltage from the direct current voltage converted with the power factor correction circuit;

a heater configured to receive the specific alternate current voltage generated with the inverter;

a data holding portion configured to store an attribute value indicating a variance of a resistivity value of the heater in advance; and an excessive temperature rise preventing portion configured to interrupt the specific alternate current voltage generated with the inverter from being supplied to the heater, wherein said power factor correction circuit includes a boost circuit configured to boost the alternate current voltage so that the boost circuit outputs the direct current voltage greater than the alternate current voltage, said inverter is configured to correct the specific alternate current voltage according to a resistivity value of the heater, said inverter includes a switching portion configured to switch the direct current voltage converted with the power factor correction circuit, and an inverter control portion configured to control the switching portion, and said inverter control portion is configured to change a switching state of the switching portion according to the attribution value of the heater determined in advance.

2. A heater control device, comprising:

a power factor correction circuit configured to convert an alternate current voltage from a commercial power source to a direct current voltage;

an inverter configured to generate a specific alternate current voltage from the direct current voltage converted with the power factor correction circuit;

a heater configured to receive the specific alternate current voltage generated with the inverter; and an excessive temperature rise preventing portion configured to interrupt the specific alternate current voltage generated with the inverter from being supplied to the heater, wherein said power factor correction circuit includes a boost circuit configured to boost the alternate current voltage so that the boost circuit outputs the direct current voltage greater than the alternate current voltage, said inverter is configured to correct the specific alternate current voltage according to a resistivity value of the heater, said inverter includes a switching portion configured to switch the direct current voltage converted with the power factor correction circuit, a first electric current detecting portion, and an inverter control portion configured to change a switching state of the switching portion according to an electric current value detected with the first electric current detecting portion, said first electric current detecting portion includes a current transformer disposed a path connecting between an output of the power factor correction circuit and the switching portion, and said first electric current detecting portion is configured to detect an electric current flowing through the path using an output of the current transformer.

3. The heater control device according to claim 1, wherein said attribution value increases when the resistivity value of the heater increases, and said inverter control portion is configured to change the switching state of the switching portion so that the specific alternate current voltage is increased when the attribution value increases.

4. The heater control device according to claim 2, wherein said inverter control portion is configured to change the switching state of the switching portion according to the electric current value detected with the first electric current detecting portion so that power consumption of the heater becomes a value determined in advance.

5. The heater control device according to claim 4, wherein said inverter control portion is configured to change the switching state of the switching portion so that the specific alternate current voltage output from the inverter is lowered when the electric current value detected with the first electric current detecting portion increase.

6. The heater control device according to claim 1, wherein said inverter includes a switching portion configured to switch the direct current voltage converted with the power factor correction circuit, a second electric current detecting portion, and an inverter control portion configured to change a switching state of the switching portion according to an electric current value detected with the first electric current detecting portion, said second electric current detecting portion includes a current transformer disposed a path connecting between an output of the power factor correction circuit and the switching portion, and said second electric current detecting portion is configured to detect an electric current flowing through the path using an output of the current transformer.

7. The heater control device according to claim 6, wherein said inverter control portion is configured to change the switching state of the switching portion so that the specific alternate current voltage is not increased when the electric current value detected with the first electric current detecting portion exceeds a threshold value determined in advance.

8. The heater control device according to claim 1, wherein said inverter control portion is configured to change the switching state of the switching portion through changing a duty ratio of a pulse signal to be output to the switching portion.

9. An image forming apparatus comprising the heater control device according to claim 1.

10. The heater control device according to claim 1, wherein said inverter is configured to generate the specific alternate current voltage having an effective value smaller than that of the direct current voltage converted with the power factor correction circuit.

11. The heater control device according to claim 10, wherein said inverter includes a first switching element connected to a positive side of the direct current voltage, and a second switching element connected to a negative side of the direct current voltage, said heater is connected to the excessive temperature rise preventing portion so that the excessive temperature rise preventing portion shuts off connection between the first switching element and the second switching element, said excessive temperature rise preventing portion is configured to flow an electric current to the heater through the first switching element and the second switching element when the first switching element and the second switching element are turned on, and said excessive temperature rise preventing portion is configured to shut off an electric current to the heater through the first switching element and the second switching element when the first switching element and the second switching element are turned off.

12. The heater control device according to claim 11, further comprising an inductor connected in series between the second switching element and the excessive temperature rise preventing portion;

a first connection line for connecting the inductor and the excessive temperature rise preventing portion;

a second connection line for connecting the first switching element and the heater; and a capacitor connected between the first connection line and the second connection line.

* * * * *